US008522713B2

(12) United States Patent
Kobori et al.

(10) Patent No.: US 8,522,713 B2
(45) Date of Patent: Sep. 3, 2013

(54) CURTAIN COATING METHOD AND CURTAIN COATING APPARATUS

(75) Inventors: Hideyuki Kobori, Numazu (JP); Shuji Hanai, Numazu (JP); Tomohito Shimizu, Numazu (JP); Nobuyuki Nagasawa, Numazu (JP); Tetsuya Hara, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 568 days.

(21) Appl. No.: 12/506,452

(22) Filed: Jul. 21, 2009

(65) Prior Publication Data

US 2010/0021645 A1 Jan. 28, 2010

(30) Foreign Application Priority Data

Jul. 22, 2008 (JP) ..... 2008-188154
May 19, 2009 (JP) ..... 2009-120552

(51) Int. Cl.
*B05C 5/00* (2006.01)

(52) U.S. Cl.
USPC ..... 118/325; 118/324; 118/300

(58) Field of Classification Search
USPC ..... 118/DIG. 4, 300
See application file for complete search history.

(56) References Cited

U.S. PATENT DOCUMENTS 4,479,987 A 10/1984 Koepke et al.
4,647,482 A 3/1987 Degrauwe et al.
5,330,797 A 7/1994 Mues
5,763,013 A * 6/1998 Devine et al. ..... 118/324
6,468,592 B1 * 10/2002 Becker et al. ..... 118/325
6,709,517 B1 3/2004 Holtmann et al.
2004/0253385 A1 12/2004 Gueggi
2007/0137563 A1 6/2007 Schweizer et al.
2008/0069965 A1 3/2008 Kobori et al.
2008/0206496 A1 8/2008 Kobori et al.
2008/0226828 A1 9/2008 Shimizu et al.

FOREIGN PATENT DOCUMENTS

DE 19735588 A1 2/1999
DE 102006019788 A1 10/2007
EP 0176632 A1 4/1986

(Continued)

OTHER PUBLICATIONS

Xiangmei Liu, Junhui He, Hierarchically structured superhydrophilic coatings fabricated by self-assembling raspberry-like silica nanospheres, Journal of Colloid and Interface Science, vol. 314, Issue 1, Oct. 1, 2007, pp. 341-345, ISSN 0021-9797, 10.1016/j.jcis.2007.05.011. (http://www.sciencedirect.com/science/article/pii/S0021979707006200).*

(Continued)

*Primary Examiner* — Dah-Wei Yuan
*Assistant Examiner* — Stephen Kitt
(74) *Attorney, Agent, or Firm* — Cooper & Dunham LLP

(57) ABSTRACT

To provide a curtain coating apparatus including: a slit from which at least one layer of a coating liquid is ejected; a curtain edge guide configured to guide the ejected coating liquid in the form of a curtain liquid film and make the coating liquid fall freely, while pouring an auxiliary liquid from the whole of a surface provided in contact with the coating liquid in the curtain edge guide, so as to apply the coating liquid onto a continuously running web; and a claw which supports the curtain liquid film at a bottom of the curtain edge guide, wherein when a residue of the liquid is left on the claw, the claw is configured to move.

9 Claims, 19 Drawing Sheets

(56) References Cited

FOREIGN PATENT DOCUMENTS

| | | | |
|---|---|---|---|
| EP | 1801289 | A1 * | 6/2007 |
| EP | 1801289 | A1 | 6/2007 |
| JP | 59-132966 | | 7/1984 |
| JP | 7-178364 | | 7/1995 |
| JP | 11-188299 | | 7/1999 |
| JP | 2000-513 | | 1/2000 |
| JP | 2000-218209 | | 8/2000 |
| JP | 2001-46939 | | 2/2001 |
| JP | 2001-104856 | | 4/2001 |
| JP | 2005/512768 | | 5/2005 |
| JP | 2008-93656 | | 4/2008 |
| JP | 2008-529753 | | 8/2008 |
| JP | 2009-95832 | | 5/2009 |
| WO | WO90/01179 | A1 | 2/1990 |
| WO | WO01/47643 | A1 | 7/2001 |
| WO | WO03/049871 | | 6/2003 |
| WO | WO2005/097352 | A1 | 10/2005 |

OTHER PUBLICATIONS

European search report in connection with a counterpart European patent application No. 09 16 6036.

Japanese official action dated May 29, 2012 in a corresponding Japanese patent application.

Japanese official action dated Nov. 20, 2012 in connection with corresponding Japanese patent application No. 2009-120552.

* cited by examiner

CURTAIN COATING METHOD AND CURTAIN COATING APPARATUS

BACKGROUND OF THE INVENTION

1. Field of the Invention

The present invention relates to a curtain coating method and a curtain coating apparatus, specifically a curtain coating method and a curtain coating apparatus in which at least one layer of a coating liquid is ejected from a slit, and the ejected coating liquid is made to fall freely by using a curtain edge guide, which guides the coating liquid in the form of a curtain liquid film, so as to apply the coating liquid onto a continuously running web.

2. Description of the Related Art

Curtain coating methods are coating methods frequently used in producing photosensitive materials and the like, for example photographic films. Among the curtain coating methods, for example, there is a method which includes ejecting a coating liquid from a nozzle slit of a curtain coating head 1, making the ejected coating liquid fall freely by using a curtain edge guide 2, which guides the coating liquid in the form of a curtain liquid film, so as to form a curtain liquid film 3, and bringing the curtain liquid film 3 into contact with a continuously running web 5 so as to form a coating film on the web, as shown in FIG. 1, and there is a method which includes ejecting a coating liquid from a slit, moving the ejected coating liquid on a slide surface 7, making the coating liquid fall freely by using a curtain edge guide 2, which guides the coating liquid in the form of a curtain liquid film, so as to form a curtain liquid film 3, and bringing the curtain liquid film 3 into contact with a continuously running web 5 so as to form a coating film on the web, as shown in FIG. 2. Also, as for multilayer coating, there is a method which includes ejecting coating liquids with various functions from respective nozzle slits, making the ejected coating liquids fall freely by using a curtain edge guide which guides the coating liquids in the form of a curtain liquid film, and bringing the curtain liquid film into contact with a continuously running web so as to form a coating film on the web, and there is a method which includes ejecting coating liquids with various functions from respective slits, depositing the ejected coating liquids on a slide surface, making the deposited coating liquids fall freely by using a curtain edge guide which guides the coating liquids in the form of a curtain liquid film, and bringing the curtain liquid film into contact with a continuously running web so as to form a coating film on the web.

Parenthetically, in such coating film forming methods, there is a phenomenon caused in which when a coating liquid flows along a curtain edge guide, the coating liquid flows slowly at both edges of the formed curtain liquid film supported by the curtain edge guide, and the coating liquid at the edges of the curtain liquid film flows in a manner that is shifted toward the central side owing to the difference in flow speed between the coating liquid at the edges of the curtain liquid film and the coating liquid on the central side of the curtain liquid film. Thus, when the coating liquid is made to fall freely and the formed curtain liquid film is brought into contact with a continuously running web so as to form a coating film on the web, there is such a drawback that the amount of the coating liquid attached becomes larger at the edges of the coating film with respect to the width direction. Consequently, there are undried portions easily existing when the coating film is dried, which causes blocking when a product is wound, and the edges swell, which causes cutting of the web when the product is wound, thereby lowering production efficiency.

As an attempt to prevent the foregoing, the drying temperature may be increased. However, there is such a problem that, regarding coating on thermosensitive paper, the thermosensitive paper develops color when the temperature of a coating film is high, thereby causing defects in products. Thus, increasing the drying temperature is not helpful in many cases.

To prevent the phenomenon in which the amount of the coating liquid attached becomes larger at the edges of the coating film, there is a well-known method which includes making the coating liquid fall freely while pouring an auxiliary liquid along edge portions at both ends of the curtain edge guide which support the formed curtain liquid film, thereby making the flow speed of the coating liquid at the edges closer to the flow speed of the coating liquid at the center (refer to Japanese Patent Application Laid-Open (JP-A) Nos. 2000-513, 2000-218209, 2001-104856, 2005-512768 and 2008-93656, for example). As shown in FIG. 3, the auxiliary liquid (auxiliary liquid 9) is sucked at a bottom of the curtain edge guide 2 and thus recovered.

However, when the auxiliary liquid is recovered, a small amount of the coating liquid is also recovered, thereby causing a residue (S) of the liquid to accumulate on a claw 10 and in a suction port 11, as shown in FIG. 4. This is a phenomenon caused because when the auxiliary liquid 9 is recovered, air flows fast in places owing to suction on the web advancing direction side of the curtain liquid film on a coating liquid contacting surface of the claw 10 and on the opposite side to the web advancing direction side, and thus the slowly flowing coating liquid in contact with the claw dries. The residue (S) accumulates with time on the claw 10 placed at a bottom of the curtain edge guide 2 at the time of continuous production, the curtain liquid film 3 becomes unable to be supported by an edge of the claw 10 owing to the residue (S), causing the curtain liquid film 3 to deviate inward, and thus the amount of the coating liquid attached becomes larger at the edges of the coating film with respect to the width direction. Consequently, the uneven coating width at the time of production leads to great production loss. Also, since the foregoing amount becomes larger, there are undried portions easily existing due to insufficient drying at the time of production, the coating liquid is possibly attached to a conveyance roll of the web during the production, later smearing the coating film surface of the web, blocking possibly arises when a product is wound, and the web is possibly cut because of the swollen edges when the product is wound, thereby lowering production efficiency.

To prevent swinging and inward deviation of a curtain liquid film in a curtain coating method, JP-A No. 11 -188299 (Troller Schweizer Engineering) discloses a curtain coating method which includes using a porous material for a curtain edge guide, and evenly pouring an auxiliary liquid onto a surface provided in contact with a curtain coating liquid in the curtain edge guide. Meanwhile, JP-A No. 2001-46939 (MITSUBISHI PAPER MILLS LIMITED.) discloses a curtain coating method which includes using a plate of glass for a surface provided in contact with a curtain coating liquid in a curtain edge guide. However, neither of these (JP-A No. 11-188299 and JP-A No. 2001-46939) discloses removal of a residue of the coating liquid and the auxiliary liquid at the bottom of the curtain edge guide.

FIG. 18A schematically shows a state in which a curtain liquid film does not deviate inward, and FIG. 18B schematically shows a state in which a curtain liquid film deviates inward.

BRIEF SUMMARY OF THE INVENTION

The present invention is designed in light of the above-mentioned problems in related art, and an object of the present invention is to provide a curtain coating method and a curtain coating apparatus, in which accumulation of a residue of liquid in a suction port and on a claw provided at a bottom of a curtain edge guide can be effectively prevented, and thus inward deviation of a curtain liquid film at the curtain edge guide can be reduced.

To solve the above-mentioned problems, a curtain coating method and a curtain coating apparatus according to the present invention have the following specific technical features denoted by <1> to <60>.

<1> A curtain coating method including: ejecting at least one layer of a coating liquid from a slit; and making the ejected coating liquid fall freely by using a curtain edge guide which guides the coating liquid in the form of a curtain liquid film, while pouring an auxiliary liquid from the whole of a surface provided in contact with the coating liquid in the curtain edge guide, so as to apply the coating liquid onto a continuously running web, wherein when a residue of the liquid is left on a claw provided to support the curtain liquid film at a bottom of the curtain edge guide, the claw is configured to move.

<2> The curtain coating method according to <1>, wherein the claw is configured to move back and forth after the coating liquid is applied onto the web for at least a certain period of time.

<3> The curtain coating method according to <1>, wherein the coating liquid is applied onto the web while continuously moving the claw back and forth.

<4> The curtain coating method according to one of <2> and <3>, wherein the rate at which the claw moves back and forth is in the range of 0.00005 m/sec to 0.005 m/sec.

<5> The curtain coating method according to <1>, wherein the claw is a disc-shaped claw, and the disc-shaped claw is configured to rotate after the coating liquid is applied onto the web for at least a certain period of time.

<6> The curtain coating method according to <1>, wherein the claw is a disc-shaped claw, and the coating liquid is applied onto the web while continuously rotating the disc-shaped claw.

<7> The curtain coating method according to one of <5> and <6>, wherein the radius of the disc-shaped claw is in the range of 10 mm to 50 mm.

<8> The curtain coating method according to any one of <5> to <7>, wherein the rate at which the disc-shaped claw rotates is in the range of 0.0001 m/sec to 0.05 m/sec.

<9> The curtain coating method according to any one of <1> to <8>, wherein the coating liquid is applied onto the web, with the claw having an edge which slopes at an angle.

<10> The curtain coating method according to <9>, wherein the angle is in the range of 0° to 45°.

<11> The curtain coating method according to any one of<1> to <10>, wherein the curtain edge guide is provided with a magnetic material, and part or all of the claw is made of a magnetic material or a material attracted to the magnetic material of the curtain edge guide.

<12> The curtain coating method according to <1>, wherein the claw is in the form of a belt and is configured to move after the coating liquid is applied onto the web for at least a certain period of time.

<13> The curtain coating method according to <1>, wherein the claw is in the form of a belt, and the coating liquid is applied onto the web while continuously moving the claw.

<14> The curtain coating method according to one of <12> and <13>, wherein the rate at which the claw moves is in the range of 0.00005 m/sec to 0.005 m/sec.

<15> The curtain coating method according to anyone of <1> to <14>, wherein the claw has a coating liquid contacting surface formed of a hydrophobic member.

<16> The curtain coating method according to any one of <1> to <15>, wherein a residue of the liquid accumulating on the claw is cleaned off.

<17> The curtain coating method according to <16>, wherein a brush is used to clean off the residue of the liquid.

<18> The curtain coating method according to <16>, wherein a scraper blade is used to clean off the residue of the liquid.

<19> A curtain coating apparatus including: a slit from which at least one layer of a coating liquid is ejected; a curtain edge guide configured to guide the ejected coating liquid in the form of a curtain liquid film and make the coating liquid fall freely, while pouring an auxiliary liquid from the whole of a surface provided in contact with the coating liquid in the curtain edge guide, so as to apply the coating liquid onto a continuously running web; and a claw which supports the curtain liquid film at a bottom of the curtain edge guide, wherein when a residue of the liquid is left on the claw, the claw is configured to move.

<20> The curtain coating apparatus according to <19>, wherein the claw is configured to move back and forth.

<21> The curtain coating apparatus according to <19>, wherein the claw is configured to move back and forth continuously.

<22> The curtain coating apparatus according to one of <20> and <21>, wherein the rate at which the claw moves back and forth is in the range of 0.00005 m/sec to 0.005 m/sec.

<23> The curtain coating apparatus according to <19>, wherein the claw is a disc-shaped claw, and the disc-shaped claw is configured to rotate.

<24> The curtain coating apparatus according to <19>, wherein the claw is a disc-shaped claw, and the disc-shaped claw is configured to rotate continuously.

<25> The curtain coating apparatus according to one of <23> and <24>, wherein the radius of the disc-shaped claw is in the range of 10 mm to 50 mm.

<26> The curtain coating apparatus according to any one of <23> to <25>, wherein the rate at which the disc-shaped claw rotates is in the range of 0.0001 m/sec to 0.05 m/sec.

<27> The curtain coating apparatus according to any one of <19> to <26>, wherein the claw has an edge which slopes at an angle.

<28> The curtain coating apparatus according to <27>, wherein the angle is in the range of 0° to 45°.

<29> The curtain coating apparatus according to any one of <19> to <28>, wherein the curtain edge guide is provided with a magnetic material, and part or all of the claw is made of a magnetic material or a material attracted to the magnetic material of the curtain edge guide.

<30> The curtain coating apparatus according to <19>, wherein the claw is in the form of a belt and is configured to move.

<31> The curtain coating apparatus according to <19>, wherein the claw is in the form of a belt and is configured to move continuously.

<32> The curtain coating apparatus according to one of <30> and <31>, wherein the rate at which the claw moves is in the range of 0.00005 m/sec to 0.005 m/sec.

<33> The curtain coating apparatus according to any one of <19> to <32>, wherein the claw has a coating liquid contacting surface formed of a hydrophobic member.

<34> The curtain coating apparatus according to any one of <19> to <33>, further including a unit configured to clean off a residue of the liquid accumulating on the claw.

<35> The curtain coating apparatus according to <34>, wherein the unit is a brush.

<36> The curtain coating apparatus according to <34>, wherein the unit is a scraper blade.

<37> A curtain coating method including: ejecting at least one layer of a coating liquid from a slit; and making the ejected coating liquid fall freely by using a curtain edge guide which guides the coating liquid in the form of a curtain liquid film, while pouring an auxiliary liquid from the whole of a surface provided in contact with the coating liquid in the curtain edge guide, so as to apply the coating liquid onto a continuously running web, wherein an additional auxiliary liquid is poured onto a curtain liquid film contacting surface of a claw provided to support the curtain liquid film at a bottom of the curtain edge guide.

<38> The curtain coating method according to <37>, wherein the coating liquid is applied onto the web, with the claw having an edge which slopes at an angle.

<39> The curtain coating method according to <38>, wherein the angle is in the range of 0° to 45°.

<40> The curtain coating method according to any one of <37> to <39>, wherein the edge of the claw has a thickness of 0.4 mm or less.

<41> The curtain coating method according to any one of <37> to <40>, wherein the additional auxiliary liquid is supplied to the curtain liquid film contacting surface of the claw, using a pouring pipe, and the additional auxiliary liquid is brought into contact with the curtain liquid film contacting surface so as to flow on the curtain liquid film contacting surface.

<42> The curtain coating method according to any one of <37> to <41>, wherein the additional auxiliary liquid is supplied to the claw, using a/the pouring pipe, and the additional auxiliary liquid is poured from an edge of the claw.

<43> The curtain coating method according to any one of <37> to <42>, wherein the additional auxiliary liquid is supplied to the claw, using a/the pouring pipe, and the additional auxiliary liquid is made to stream out of the curtain liquid film contacting surface of the claw so as to flow on the curtain liquid film contacting surface.

<44> The curtain coating method according to any one of <37> to <43>, wherein the curtain liquid film contacting surface of the claw is formed of a superhydrophilic film which contains a superhydrophilic material.

<45> The curtain coating method according to <44>, wherein the superhydrophilic film contains a photocatalyst.

<46> The curtain coating method according to <45>, wherein the claw is irradiated with light so as to sustain an excited state of the photocatalyst contained in the superhydrophilic film.

<47> The curtain coating method according to <46>, wherein the claw is made of an ultraviolet-transmitting member, light is applied from the surface of the claw where the superhydrophilic film is not formed, and the excited state of the photocatalyst is thus sustained.

<48> The curtain coating method according to any one of <44> to <47>, wherein when a residue of the liquid is left on the claw, the claw is configured to move.

<49> A curtain coating apparatus including: a slit from which at least one layer of a coating liquid is ejected; a curtain edge guide configured to guide the ejected coating liquid in the form of a curtain liquid film and make the coating liquid fall freely, while pouring an auxiliary liquid from the whole of a surface provided in contact with the coating liquid in the curtain edge guide, so as to apply the coating liquid onto a continuously running web; a claw configured to support the curtain liquid film at a bottom of the curtain edge guide; and a unit configured to pour an additional auxiliary liquid onto a curtain liquid film contacting surface of the claw.

<50> The curtain coating apparatus according to <49>, wherein the claw has an edge which slopes at an angle.

<51> The curtain coating apparatus according to <50>, wherein the angle is in the range of 0° to 45°.

<52> The curtain coating apparatus according to any one of <49> to <51>, wherein the edge of the claw has a thickness of 0.4 mm or less.

<53> The curtain coating apparatus according to any one of <49> to <52>, further including a pouring pipe for supplying the additional auxiliary liquid to the curtain liquid film contacting surface of the claw, and a unit configured to bring the additional auxiliary liquid into contact with the curtain liquid film contacting surface of the claw such that the additional auxiliary liquid flows on the curtain liquid film contacting surface.

<54> The curtain coating apparatus according to any one of <49> to <53>, (further) including a/the pouring pipe for supplying the additional auxiliary liquid to the claw, and a unit configured to pour the additional auxiliary liquid from an edge of the claw.

<55> The curtain coating apparatus according to any one of <49> to <54>, (further) including a/the pouring pipe for supplying the additional auxiliary liquid to the claw, and a unit configured to get the additional auxiliary liquid to stream out of the curtain liquid film contacting surface of the claw so as to flow on the curtain liquid film contacting surface.

<56> The curtain coating apparatus according to any one of <49> to <55>, wherein the curtain liquid film contacting surface of the claw is formed of a superhydrophilic film which contains a superhydrophilic material.

<57> The curtain coating apparatus according to <56>, wherein the superhydrophilic film contains a photocatalyst.

<58> The curtain coating apparatus according to <57>, further including a light irradiation device configured to irradiate the superhydrophilic film of the claw with light.

<59> The curtain coating apparatus according to <58>, wherein the claw is made of an ultraviolet-transmitting member, and the light is applied by the light irradiation device from the surface of the claw where the superhydrophilic film is not formed.

<60> The curtain coating apparatus according to any one of <55> to <59>, wherein when a residue of the liquid is left on the claw, the claw is configured to move.

According to the present invention, it is possible to provide a curtain coating method and a curtain coating apparatus, in which accumulation of a residue of liquid on a claw provided at a bottom of a curtain edge guide can be effectively prevented, and thus inward deviation of a curtain liquid film at the curtain edge guide can be is reduced.

DETAILED DESCRIPTION OF THE INVENTION

Figure 1:
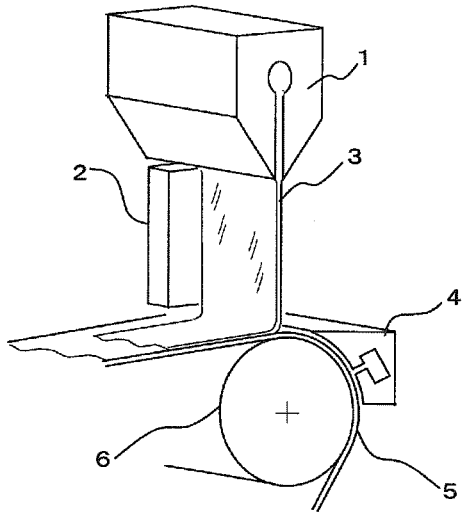
FIG. 1 (Prior Art)
FIG. 1 is a perspective view showing a structural example of a conventional curtain coating apparatus.

The present invention provides a curtain coating apparatus and a curtain coating method, in which when a residue of liquid is left on a claw provided to support a curtain liquid film at a bottom of a curtain edge guide, the residue is removed.

Broadly, as units (methods) for removing the residue, the following will be explained: a unit (and a method) for moving the claw when a residue of liquid is left on the claw; and a unit (and a method) for pouring an auxiliary liquid onto a curtain liquid film contacting surface of the claw. It should be noted that the curtain coating apparatus (and the curtain coating method) of the present invention may employ both of these units (methods).

The present invention includes (A) and (B) below.

(A) A curtain coating method including: ejecting at least one layer of a coating liquid from a slit; and making the ejected coating liquid fall freely by using a curtain edge guide which guides the coating liquid in the form of a curtain liquid film, while pouring an auxiliary liquid from the whole of a surface provided in contact with the coating liquid in the curtain edge guide, so as to apply the coating liquid onto a continuously running web, wherein when a residue of the liquid is left on a claw provided to support the curtain liquid film at a bottom of the curtain edge guide, the claw is configured to move.

(B) A curtain coating apparatus including: a slit from which at least one layer of a coating liquid is ejected; a curtain edge guide configured to guide the ejected coating liquid in the form of a curtain liquid film and make the coating liquid fall freely, while pouring an auxiliary liquid from the whole of a surface provided in contact with the coating liquid in the curtain edge guide, so as to apply the coating liquid onto a continuously running web; and a claw which supports the curtain liquid film at a bottom of the curtain edge guide, wherein when a residue of the liquid is left on the claw, the claw is configured to move.

Specifically, the present invention provides a curtain coating method and a curtain coating apparatus, wherein when a residue of liquid is left on a claw provided to support a curtain liquid film at a bottom of a curtain edge guide, the claw is moved so as to remove the residue from a curtain liquid film contacting surface of the claw and the vicinity thereof, and thus inward deviation of the curtain liquid film at the curtain edge guide, caused by accumulation of the residue on the curtain liquid film contacting surface and in a suction port, can be reduced; and wherein by cleaning off the residue remaining on the claw, which has been removed from the curtain liquid film contacting surface, it is always possible to prevent inward deviation of the curtain liquid film.

As described above, regarding the curtain coating method and the curtain coating apparatus of the present invention, in order to stabilize a curtain liquid film, a coating liquid is applied onto a continuously running web while pouring an auxiliary liquid from the surface provided in contact with the curtain liquid film in the curtain edge guide. The auxiliary liquid is not particularly limited as long as it is in liquid form and has fluidity. In the case where the coating liquid is an aqueous liquid, preferred examples of the auxiliary liquid include water, and solutions prepared by mixing water with resins or by mixing water with surfactants, etc. In the case where the coating liquid is a solvent-like liquid, preferred examples of the auxiliary liquid include the solvent contained in the coating liquid, and solutions prepared by mixing the solvent with resins or by mixing the solvent with surfactants, etc.

The shape of the claw may be arbitrarily decided as long as the claw can support the curtain liquid film at the bottom of the curtain edge guide and receive the auxiliary liquid which has flowed down. Generally though, the claw is in the form of a flat surface. The material for the claw may be arbitrarily selected unless it is corroded by the coating liquid and the auxiliary liquid. Generally though, the material is selected from stainless steel, brass, aluminum, iron, glass, PET and so forth.

The following explains the present invention (a curtain coating method and a curtain coating apparatus) in further detail, referring to the drawings.

Since the embodiments described below are embodiments suitable for the present invention, they are subject to various limitations which are technically preferred. It should be noted that the scope of the present invention is not confined to these embodiments unless otherwise stated.

(First Embodiment)

A first embodiment of the present invention is an embodiment in which curtain coating is performed using a claw in the form of a flat plate.

Figure 5A:
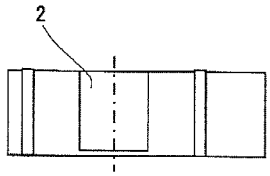
FIG. 5A is a schematic top view showing a structural example of a curtain coating apparatus provided with a claw which supports a curtain liquid film at a bottom of a curtain edge guide.
Figure 5B:
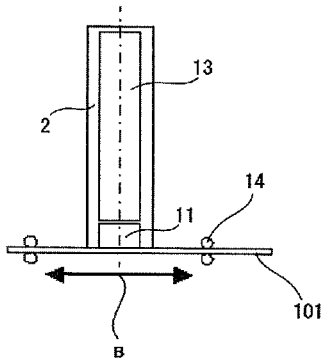
FIG. 5B is a schematic front view of the curtain coating apparatus shown in FIG. 5A.
Figure 5C:
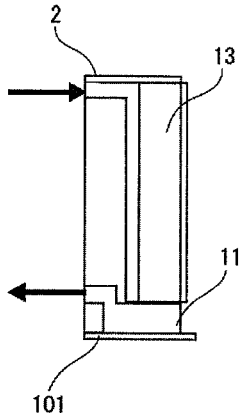
FIG. 5C is a schematic side view of the curtain coating apparatus shown in FIG. 5A.

In this curtain coating method, as shown in FIGS. 5A to 5C, it is desirable that a claw (claw configured to move back and forth) 101 placed at a bottom of a curtain edge guide 2 be moved back and forth (in the directions of the arrow B) a certain period of time after application of a coating liquid, or that the claw 101 be continuously moved back and forth from the beginning of the application of the coating liquid or a certain period of time after the application of the coating liquid, thereby preventing a residue of the liquid from accumulating on a curtain liquid film contacting surface of the claw. Especially when the coating liquid is applied while continuously moving the claw 101 back and forth, it is possible to further reduce inward deviation of a curtain liquid film at the curtain edge guide 2. Accordingly, the curtain coating apparatus is provided with a function is of moving the claw back and forth. Also, the residue is removed by suction using a residue-sucking vacuum unit (not shown) or the like.

The rate at which the claw 101 moves back and forth is in the range of 0.00005 m/sec to 0.005 m/sec. If the rate is less than 0.00005 m/sec, a residue of the liquid accumulates on the curtain liquid film contacting surface of the claw, and thus the curtain liquid film deviates inward. If the rate is greater than 0.005 m/sec, the curtain liquid film cannot be supported by an edge of the claw, and thus the curtain liquid film deviates inward.

(Second Embodiment)

A second embodiment of the present invention is an embodiment in which curtain coating is performed using a claw in the shape of a disc.

Figure 10A:
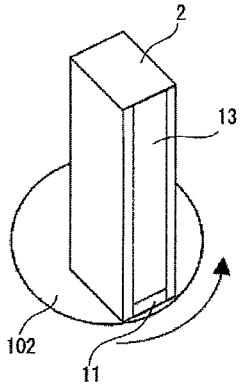
FIG. 10A is a drawing showing the positional relationship between a disc-shaped claw 102 which rotates and a curtain edge guide.
Figure 10B:
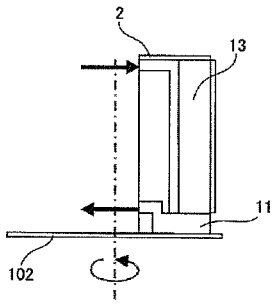
FIG. 10B is a schematic front view showing a structural example of a curtain coating apparatus provided with the claw 102 which supports a curtain liquid film at a bottom of the curtain edge guide.

FIG. 10A shows how a disc-shaped claw 102 rotates. FIG. 10B shows that the disc-shaped claw 102 is placed at a bottom of the curtain edge guide 2. An auxiliary liquid is poured from a surface provided in contact with a coating liquid in the curtain edge guide 2 and made to flow through a porous member 13.

It is desirable that the claw 102 at the bottom of the curtain edge guide 2 be rotated a certain period of time after application of the coating liquid, or that the claw 102 be continuously rotated from the beginning of the application of the coating liquid or a certain period of time after the application of the coating liquid, thereby preventing a residue of the liquid from accumulating on a curtain liquid film contacting surface of the claw. Especially when the coating liquid is applied while continuously rotating the claw 102, it is possible to further reduce inward deviation of a curtain liquid film at the curtain edge guide 2. Accordingly, the curtain coating apparatus is provided with a function of rotating the claw (which includes continuously rotating the claw). Also, the residue is removed by suction using a residue-sucking vacuum unit (not shown) or the like.

It is appropriate that the radius of the disc-shaped claw 102 be in the range of 10 mm to 50 mm. If the radius is less than 10 mm, the curvature of a portion of the claw to support the curtain liquid film is so great that the curtain liquid film swings when applied, and thus the coating width becomes unstable. If the radius is greater than 50 mm, the apparatus cannot be made compact.

Also, the rotational rate of the claw 102 as a circumferential speed is in the range of 0.0001 m/sec to 0.05 m/sec. If the rotational rate as a circumferential speed is less than 0.0001 m/sec, a residue of the liquid accumulates on the curtain liquid film contacting surface of the claw, and thus the curtain liquid film deviates inward. If the rotational rate as a circumferential speed is greater than 0.05 m/sec, the curtain liquid film cannot be supported by an edge of the claw, and thus the curtain liquid film deviates inward.

(Third Embodiment)

A third embodiment of the present invention is an embodiment in which curtain coating is performed using a claw in the form of a belt.

Figure 15A:
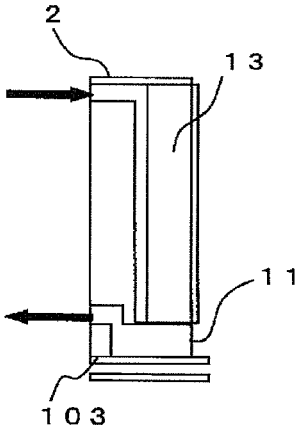
FIG. 15A is a schematic side view showing a structural example of a curtain coating apparatus provided with a claw 103 which supports a curtain liquid film at a bottom of a curtain edge guide.
Figure 15B:
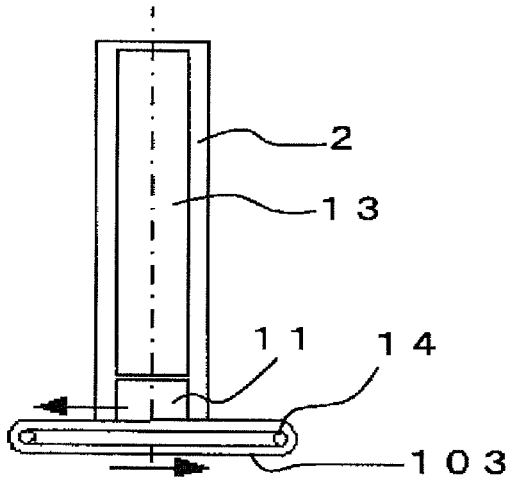
FIG. 15B is a schematic front view of the curtain coating apparatus shown in FIG. 15A.

FIG. 15A shows that a belt-like claw 103 is placed at a bottom of the curtain edge guide 2. FIG. 15B shows how the belt-like claw 103 moves in one direction (the direction of the arrow). In FIG. 15B, the numeral 14 denotes driving rubber roll(s).

In this embodiment, the belt-like claw 103 is moved at least a certain period of time after application of a coating liquid so as to remove a residue of the liquid from a curtain liquid film contacting surface of the claw, and thus inward deviation of a curtain liquid film at the curtain edge guide 2, caused by accumulation of the residue on the curtain liquid film contacting surface, can be reduced. Also, it is possible to further reduce inward deviation of the curtain liquid film at the curtain edge guide 2 by applying the coating liquid while continuously moving the belt-like claw 103 at the bottom of the curtain edge guide 2, and thus always preventing a residue of the liquid from accumulating on the curtain liquid film contacting surface. Also, the residue is removed by suction using a residue-sucking vacuum unit (not shown) or the like. Accordingly, the curtain coating apparatus is provided with a function of moving the claw in the form of a belt (which includes continuously moving the claw).

The rate at which the belt-like claw 103 moves is in the range of 0.00005 m/sec to 0.005 m/sec. If the rate is less than 0.00005 m/sec, a residue of the liquid accumulates on the curtain liquid film contacting surface of the claw, and thus the curtain liquid film deviates inward. If the rate is greater than 0.005 m/sec, the curtain liquid film cannot be supported by an edge of the claw, and thus the curtain liquid film deviates inward.

(Fourth Embodiment)

A fourth embodiment of the present invention is an embodiment in which curtain coating is performed using the claw (claw configured to move back and forth) 101 having an edge that slopes at an angle θ, and the disc-shaped claw 102 having an edge (peripheral portion) that slopes at an angle θ.

Figure 6:
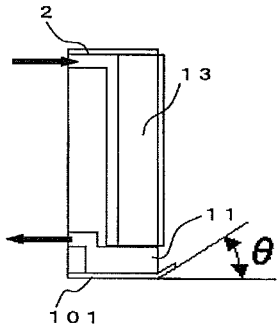
FIG. 6 is a schematic front view showing a structural example of a curtain coating apparatus in which one edge of a claw 101 slopes at an angle.
Figure 11:
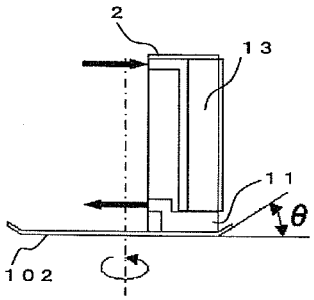
FIG. 11 is a schematic front view showing a structural example of a curtain coating apparatus in which an edge (peripheral portion) of the claw 102 slopes at an angle.

FIG. 6 shows a state in which one edge of the claw 101 slopes upward at an angle θ. FIG. 11 shows a state in which a peripheral portion of the claw 102 slopes upward at an angle θ.

When the claws 101 and 102 have edges sloping at an angle θ as described above, it becomes easier for curtain liquid films to be in contact with the respective claws when applied onto webs, which enables the claws to support edges of the curtain liquid films to a greater extent (there is an increase in contact area between the claws and the curtain liquid films), and thus it becomes possible to further reduce inward deviation of the curtain liquid films, caused by residues of liquid left on the curtain liquid film contacting surfaces of the claws.

The angle θ is preferably in the range of 0° to 45°, more preferably in the range of 10° to 35°. When the angle θ is less than 0°, the edges of the curtain liquid films cannot be sufficiently supported by the respective claws, and thus the curtain liquid films deviate inward upon deposition of even small amounts of residues on the curtain liquid film contacting surfaces of the claws. When the angle θ is greater than 45°, coating liquids easily move to the backs of the respective claws 101 and 102 and the amounts of the coating liquids attached become larger at edges of coating films with respect to the coating width direction; thus, there are undried portions easily existing due to insufficient drying at the time of production, the coating liquids are possibly attached to conveyance rolls of the webs during the production, later smearing the coating film surfaces of the webs, blocking possibly arises when products are wound, and the webs are possibly cut because of the swollen edges when the products are wound.

(Fifth Embodiment)

A fifth embodiment of the present invention is an embodiment in which curtain coating is performed using the curtain edge guide 2 provided with a magnetic material 15; the claw (claw configured to move back and forth) 101, part or all of which is made of a magnetic material or a material attracted to the magnetic material 15 of the curtain edge guide 2; and the disc-shaped claw 102, part or all of which is made of a magnetic material or a material attracted to the magnetic material 15 of the curtain edge guide 2.

Figure 7A:
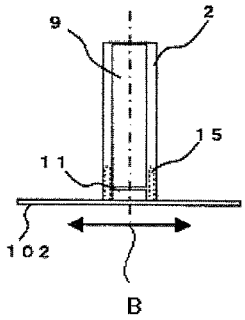
FIG. 7A is a schematic front view showing a structural example of a curtain coating apparatus in which attachment of a claw 101 to a curtain edge guide 2 is facilitated.
Figure 7B:
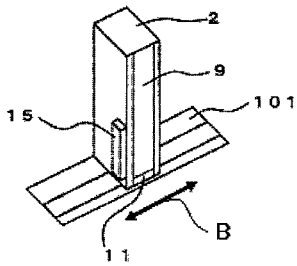
FIG. 7B is a schematic perspective view of the curtain coating apparatus shown in FIG. 7A.

FIGS. 7A and 7B each show that the employment of the above-mentioned structure makes it possible for the claw 101 to move back and forth in the directions of the arrow B. Similarly, FIGS. 12A and 12B each show that the employment of the above-mentioned structure makes it possible for the claw 102 to rotate.

Thus, as shown in FIG. 7B, the claw 101 can slide easily, so that a state in which there is no residue of liquid present on the curtain liquid film contacting surface of the claw can be easily achieved, and thus inward deviation of a curtain liquid film at the curtain edge guide 2 can be reduced. Meanwhile, as shown in FIG. 12B, the disc-shaped claw 102 can rotate easily, so that a state in which there is no residue of liquid present on the curtain liquid film contacting surface of the claw can be easily achieved, and thus inward deviation of a curtain liquid film at the curtain edge guide 2 can be reduced.

Preferred examples of the magnetic material include magnetite, KS steel, MK steel, ferrite magnets, samarium-cobalt magnets, alnico magnets, neodymium magnets, samarium-iron-nitrogen magnets, platinum magnets, praseodymium magnets, plastic magnets, manganese-aluminum magnets, iron-chromium-cobalt magnets, bond magnets and molecular magnets. Preferred examples of the material attracted to the magnetic material 15 include iron and stainless steel.

(Sixth Embodiment)

A sixth embodiment of the present invention is an embodiment in which curtain coating is performed using a hydrophobic member to form a coating liquid (curtain liquid film) contacting surface of a claw.

The use of the hydrophobic member to form the coating liquid (curtain liquid film) contacting surface of the claw makes it possible for the claw to repel water contained in a coating liquid and in an auxiliary liquid, and thus it is possible to reduce accumulation of a residue of the liquid on the curtain liquid film contacting surface of the claw and prevent inward deviation of a curtain liquid film. Examples of the hydrophobic member include resins such as Teflon (registered trademark), and silicon resins.

(Seventh Embodiment)

A seventh embodiment of the present invention is an embodiment in which curtain coating is performed after or while cleaning off a residue of liquid accumulating on a claw.

A brush, a scraper blade or the like is used to clean off the residue. Also, a residue-sucking vacuum unit configured to suck in the residue is provided in the vicinity of the brush, the scraper blade or the like.

Figure 8A:
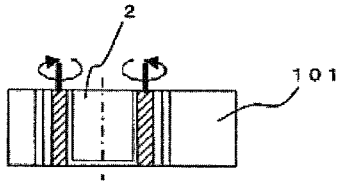
FIG. 8A is a schematic top view showing a structural example of a curtain coating apparatus provided with a unit configured to clean off a residue of liquid accumulating on the claw 101.
Figure 8B:
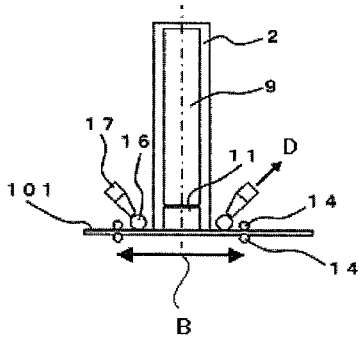
FIG. 8B is a schematic front view of the curtain coating apparatus shown in FIG. 8A.
Figure 9A:
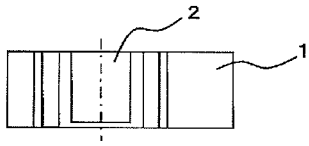
FIG. 9A is a schematic top view showing a structural example of a curtain coating apparatus provided with another unit configured to clean off a residue of liquid accumulating on the claw 101.
Figure 9B:
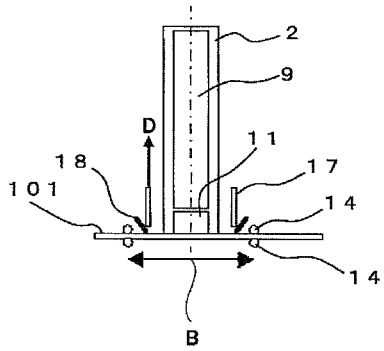
FIG. 9B is a schematic front view of the curtain coating apparatus shown in FIG. 9A.

FIGS. 8A and 8B and FIGS. 9A and 9B each show that there is a device provided to clean off a residue of liquid left on the claw 101, while the curtain liquid film contacting surface of the claw 101 at the bottom of the curtain edge guide 2 is being continuously moved back and forth. FIGS. 8A and 8B are drawings showing an example in which brushes 16 are used to clean off a residue of liquid, and FIGS. 9A and 9B are drawings showing an example in which scraper blades 18 are used to clean off a residue of liquid. In these drawings, the numeral 17 denotes residue-sucking vacuum unit(s) configured to suck in the residue. As regards the foregoing, since the residue is rubbed off by the brushes, the scraper blades or the like and sucked (in the direction of the arrow D) by the vacuum units 17, it is possible at the time of continuous production to prevent accumulation of the residue on the liquid contacting surface of the claw and thus prevent inward deviation of a curtain liquid film.

Figure 13A:
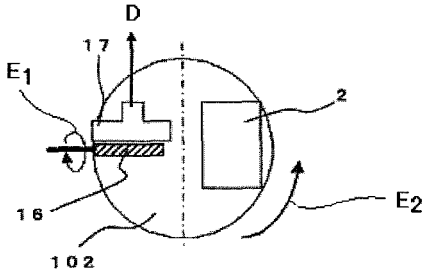
FIG. 13A is a schematic top view showing a structural example of a curtain coating apparatus provided with a unit configured to clean off a residue of liquid accumulating on the claw 102.
Figure 13B:
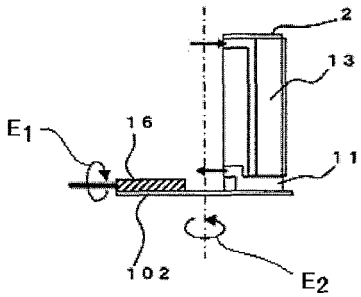
FIG. 13B is a schematic front view of the curtain coating apparatus shown in FIG. 13A.
Figure 14A:
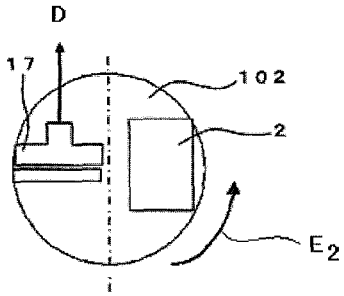
FIG. 14A is a schematic top view showing a structural example of a curtain coating apparatus provided with another unit configured to clean off a residue of liquid accumulating on the claw 102.
Figure 14B:
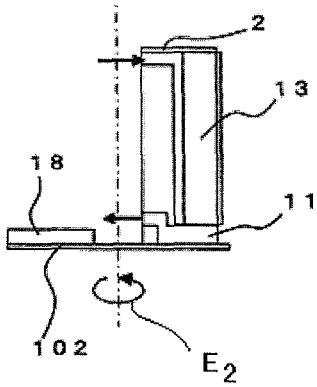
FIG. 14B is a schematic front view of the curtain coating apparatus shown in FIG. 14A.

FIGS. 13A and 13B and FIGS. 14A and 14B each show that there is a device provided to clean off a residue of liquid left on the disc-shaped claw 102, while the claw 102 is being continuously rotated, thereby making it possible at the time of continuous production to prevent accumulation of the residue on the liquid contacting surface of the claw and thus prevent inward deviation of a curtain liquid film. FIGS. 13A and 13B are drawings showing an example in which a brush 16 is used to clean off a residue of liquid, and FIGS. 14A and 14B are drawings showing an example in which a scraper blade 18 is used to clean off a residue of liquid.

Figure 16A:
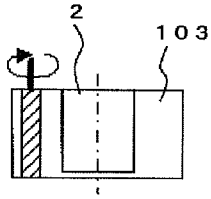
FIG. 16A is a schematic top view showing a structural example of a curtain coating apparatus provided with a unit configured to clean off a residue of liquid accumulating on the claw 103.
Figure 16B:
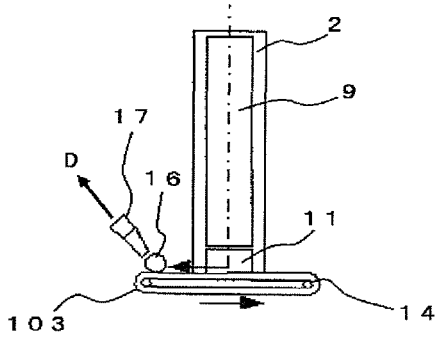
FIG. 16B is a schematic front view of the curtain coating apparatus shown in FIG. 16A.
Figure 17A:
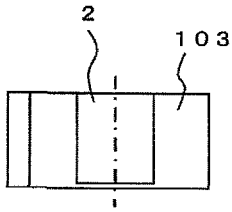
FIG. 17A is a schematic top view showing a structural example of a curtain coating apparatus provided with another unit configured to clean off a residue of liquid accumulating on the claw 103.
Figure 17B:
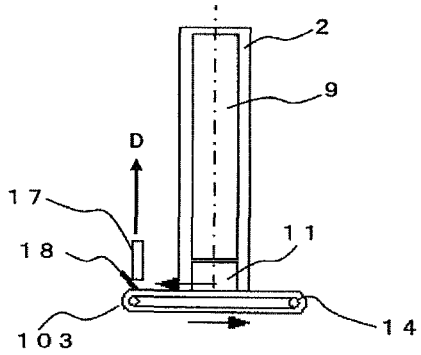
FIG. 17B is a schematic front view of the curtain coating apparatus shown in FIG. 17A.
Figure 18A:
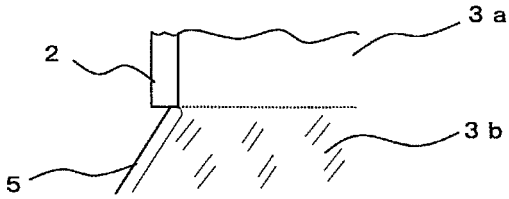
FIG. 18A is a schematic drawing showing a state in which a curtain liquid film does not deviate inward.
Figure 18B:
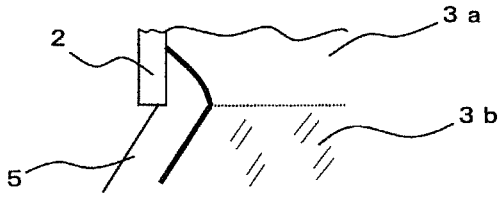
FIG. 18B is a schematic drawing showing a state in which a curtain liquid film deviates inward.

Meanwhile, FIGS. 16A and 16B and FIGS. 17A and 17B each show that there is a device provided to clean off a residue of liquid left on the belt-like claw 103, while the claw 103 is being moved in one direction, thereby making it possible at the time of continuous production to prevent accumulation of the residue on the liquid contacting surface of the claw (the residue is sucked in the direction of the arrow D by a vacuum unit 17) and thus prevent inward deviation of a curtain liquid film. FIGS. 16A and 16B are drawings showing an example in which a brush 16is used to clean off a residue of liquid, and FIGS. 17A and 17B are drawings showing an example in which a scraper blade 18 is used to clean off a residue of liquid.

(Eighth Embodiment)

A curtain coating method and a curtain coating apparatus of an eighth embodiment of the present invention are exemplarily represented by FIGS. 19A and 19B and are as follows: at least one layer of a coating liquid 12 is ejected from a slit, and the ejected coating liquid is made to fall freely by the curtain edge guide 2, which guides the coating liquid in the form of a curtain liquid film, so as to form a curtain liquid film 19 and apply the curtain liquid film 19 onto a continuously running web 5, while an auxiliary liquid is poured from the whole of a surface provided in contact with the coating liquid in the curtain edge guide, wherein an additional auxiliary liquid is made to flow as far as an edge of a claw surface where the curtain liquid film 19 (coating liquid 12) comes into contact with a claw 21 provided at a bottom of the curtain edge guide 2, so as to form a liquid film 202 of the additional auxiliary liquid between the claw 21 and the coating liquid 12 to be sucked into a suction port 22, and thus formation of a residue of the liquid on the liquid contacting surface of the claw can be reduced.

The auxiliary liquid poured onto the surface provided in contact with the coating liquid in the curtain edge guide (hereinafter referred to as "curtain edge guide auxiliary liquid") and the additional auxiliary liquid poured onto the claw's surface which is in contact with the coating liquid (hereinafter referred to as "claw liquid-contacting surface auxiliary liquid") may be the same or different.

The additional auxiliary liquid is not particularly limited as long as it is in liquid form and has fluidity. In the case where the coating liquid is an aqueous liquid, examples of the additional auxiliary liquid include water, and solutions prepared by mixing water with resins or by mixing water with surfactants, etc. In the case where the coating liquid is a solvent-like liquid, examples of the auxiliary liquid include the solvent contained in the coating liquid, and solutions prepared by mixing the solvent with resins or by mixing the solvent with surfactants, etc. It should be noted that in the case where a solution containing a resin is used, the resin itself contained in the claw liquid-contacting surface auxiliary liquid may possibly be left as a residue, so that the claw liquid-contacting surface auxiliary liquid is preferably different from the curtain edge guide auxiliary liquid. Accordingly, in the case where the coating liquid is an aqueous liquid, the claw liquid-contacting surface auxiliary liquid is preferably water, or a solution prepared by mixing water with a surfactant, etc. In the case the coating liquid is a solvent-like liquid, the claw liquid-contacting surface auxiliary liquid is preferably the solvent contained in the coating liquid, or a solution prepared by mixing the solvent with a surfactant, etc.

Specific examples of the auxiliary liquid include water; alcohols such as methanol, ethanol, isopropanol, n-butanol and methylisocarbinol; ketones such as acetone, 2-butanone, ethyl amyl ketone, diacetone alcohol, isophorone and cyclohexanone; amides such as N,N-dimethylformamide and N,N-dimethylacetoamide; ethers such as diethyl ether, isopropyl ether, tetrahydrofuran, 1,4-dioxane and 3,4-dihydro-2H-pyran; glycol ethers such as 2-methoxyethanol, 2-ethoxyethanol, 2-butoxyethanol and ethyleneglycol dimethylether; glycol ether acetates such as 2-methoxyethyl acetate, 2-ethoxyethyl acetate and 2-butoxyethyl acetate; esters such as methyl acetate, ethyl acetate, isobutyl acetate, amyl acetate, ethyl lactate and ethylene carbonate; aromatic hydrocarbons such as benzene, toluene and xylene; aliphatic hydrocarbons such as hexane, heptane, iso-octane and cyclohexane; halogenated hydrocarbons such as methylene chloride, 1,2-dichlorethane, dichloropropane and chlorbenzene; sulfoxides such as dimethylsulfoxide; and pyrrolidones such as N-methyl-2-pyrrolidone and N-octyl-2-pyrrolidone.

The material for the claw 21 is not particularly limited unless it is corroded by the coating liquid and the auxiliary liquid, and the material may be arbitrarily selected. Examples thereof include stainless steel, brass, aluminum, iron, glass and PET.

Figure 20:
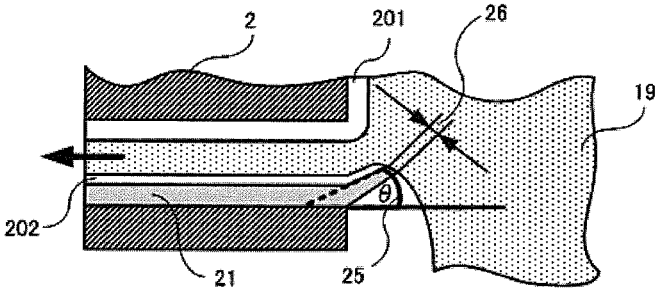
FIG. 20 is an explanatory drawing showing the angle at which an edge of a claw of a curtain coating apparatus of the present invention slopes, and the thickness of the edge of the claw.

Regarding the shape of the claw 21, as shown in FIG. 20, an edge of the claw 21 preferably slopes at an angle 25 (θ). When the edge of the claw slopes at an angle, it becomes easier for the curtain liquid film 19 to be in contact with the claw, and there is an increase in contact area between the claw and the curtain liquid film; therefore, the claw supports an edge of the curtain liquid film 19 to a greater extent, and thus it becomes possible to reduce inward deviation of the curtain liquid film.

The angle 25 at which the edge of the claw 21 slopes is preferably in the range of 0° to 45°. When the angle 25 is smaller than 0°, it is impossible to form a film of the auxiliary liquid between a member of the claw and the coating liquid to be sucked, and the edge of the curtain liquid film cannot be sufficiently supported by the claw, thus causing the curtain liquid film to deviate inward upon deposition of even a small amount of a residue of the liquid. When the angle 25 is larger than 45°, the coating liquid easily moves to the back of the claw, so that the amount of the coating liquid attached becomes larger at edges of a coating film with respect to the coating width direction, and the coating film may not be sufficiently dried at the time of production. Owing to the existence of undried portions, the coating liquid is possibly attached to a conveyance roll of a web, later smearing the coating film surface of the web, blocking possibly arises when a product is wound, and the web is possibly cut because of the swollen edges when the product is wound.

The thickness 26 of the edge of the claw 21 is preferably 0.4 mm or less. When the thickness 26 is greater than 0.4 mm, it is impossible to form a film of the auxiliary liquid between the member of the claw and the coating liquid, and thus a residue of the liquid is attached to the liquid contacting surface at the edge of the claw, causing inward deviation of the curtain liquid film.

Examples of units and methods for supplying the auxiliary liquid to the claw and pouring it onto the surface of the claw are as follows.

Figure 21:
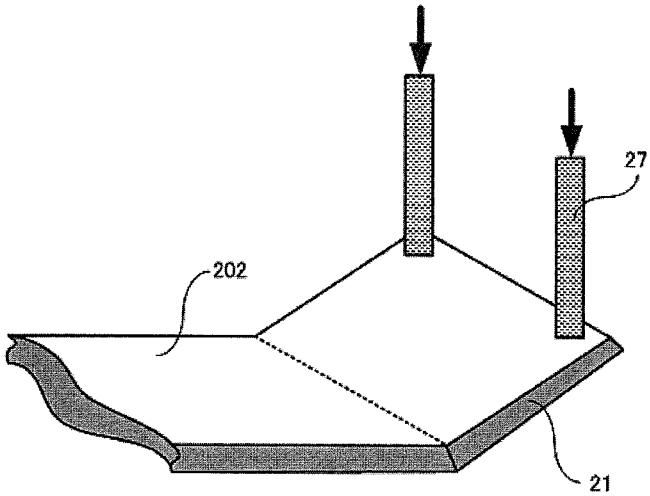
FIG. 21 is an explanatory drawing of a curtain coating apparatus of the present invention, showing an example of a pouring pipe for pouring an auxiliary liquid onto a claw.
Figure 22:
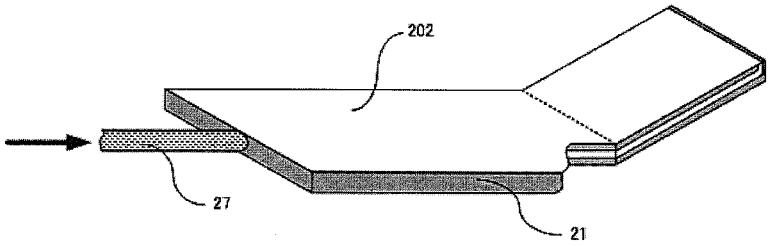
FIG. 22 is an explanatory drawing showing an example of an aspect of a curtain coating apparatus of the present invention, in which an auxiliary liquid is poured from an edge of a claw.
Figure 23:
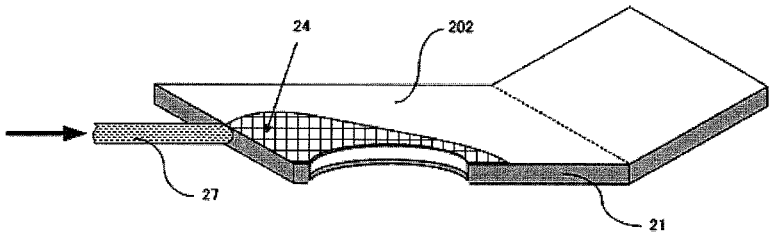
FIG. 23 is an explanatory drawing showing another example of an aspect of a curtain coating apparatus of the present invention, in which an auxiliary liquid is made to stream out of a liquid contacting surface of a claw so as to flow on the liquid contacting surface.

(1) A unit and a method for pouring the auxiliary liquid from the edge onto the surface of the claw 21 by the use of pouring pipes 27, as shown in FIG. 21. (2) A unit and a method for supplying the auxiliary liquid to the edge of the claw 21 by the use of a pouring pipe 27 or the like and pouring the auxiliary liquid from the edge (for example, via the inside of the claw), as shown in FIG. 22. (3) A unit and a method for supplying the auxiliary liquid by the use of a pouring pipe 27 or the like and getting the auxiliary liquid to stream onto the whole surface of the claw 21 and to flow as far as the edge of the claw, wherein the surface of the claw, which is in contact with the coating liquid, is made of a mesh member, a porous member, etc., as shown in FIG. 23.

Use of any of these units and methods makes it possible for the auxiliary liquid (claw liquid-contacting surface auxiliary liquid 202) to is flow on the claw's surface which is in contact with the coating liquid, and thus makes it possible to reduce formation of a residue of the liquid.

(Ninth Embodiment)

Figure 24:
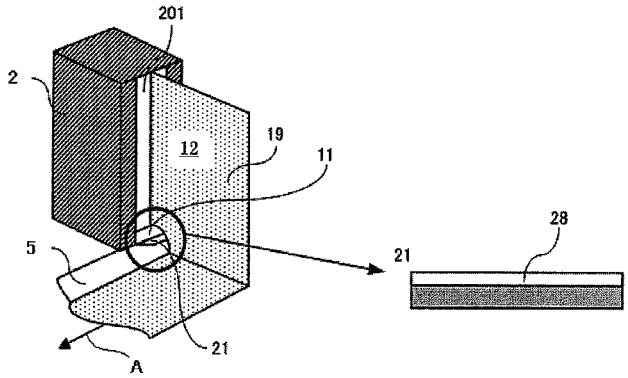
FIG. 24 is a cross-sectional view of a claw of a curtain coating apparatus of the present invention, showing an aspect in which the claw is provided with a superhydrophilic film as its surface.

A ninth embodiment of the present invention is an embodiment in which the claw 21, placed at the bottom of the curtain edge guide 2, has as its surface a superhydrophilic film 28 that exhibits superhydrophilicity, as shown in FIG. 24.

By providing the superhydrophilic film on the surface of the claw, i.e. the claw's surface which is in contact with a coating liquid, a liquid film is formed over the surface of the coating liquid to be sucked together with an auxiliary liquid, and this liquid film makes it possible to reduce formation of a residue of the liquid.

Examples of methods for forming the superhydrophilic film include a method of coating the claw surface with a composition which contains a superhydrophilic material, and a method of affixing to the claw surface a film or sheet which contains a superhydrophilic material.

Examples of the superhydrophilic material include photocatalysts. A photocatalyst is a material wherein when the material absorbs light having energy that exceeds the band gap energy, which is the energy difference between energy bands of a crystal of the material, i.e. between the upper limit of its valence band and the lower limit of its conduction band, photoexcitation occurs in which electrons in the valence band are excited into the conduction band, and these electrons and electron holes left due to the lack of electrons in the valence band induce photocatalytic reaction. Examples of the photocatalysts include titanium oxide, zinc oxide, tin oxide, ferric oxide and dibismuth trioxide. Among these, preference is given to titanium oxide because it improves in hydrophilicity with light absorption and is therefore superior in wettability.

(Tenth Embodiment)

Figure 25:
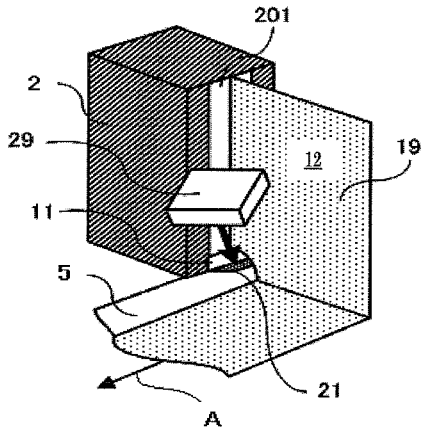
FIG. 25 is a schematic drawing showing a structural example of a curtain coating apparatus of the present invention, which includes a light irradiation device.

A tenth embodiment of the present invention is an embodiment in which a light irradiation device 29 is provided so as to irradiate the surface of the claw 21 with excitation light, as shown in FIG. 25.

By continuously irradiating the surface of the claw 21 with excitation light from the light irradiation device 29, it is possible to sustain an excited state of a photocatalyst provided for the surface of the claw 21 and thus to reduce formation of a residue of liquid.

The excitation light is not particularly limited as long as it can excite the photocatalyst. For example, it is preferable to use an ultraviolet ray therefor. Examples of the light irradiation device configured to apply an ultraviolet ray include light irradiation units incorporating light sources such as germicidal lamps, black lights, xenon lamps, metal halide lamps and mercury vapor lamps. Irradiation with the excitation light makes it easily possible to sustain the excited state of the photocatalyst.

(Eleventh Embodiment)

Figure 26:
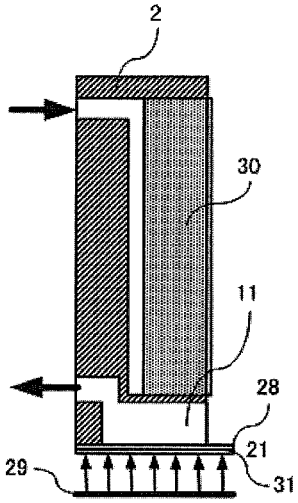
FIG. 26 is a cross-sectional view of a curtain edge guide of a curtain coating apparatus of the present invention, the curtain coating apparatus also including a light irradiation device, and a claw provided with an ultraviolet-transmitting member.

An eleventh embodiment of the present invention is an embodiment in which an ultraviolet-transmitting member 31 is used to constitute the claw 21 placed at the bottom of the curtain edge guide 2, and the claw has the superhydrophilic film 28 as its surface, as shown in FIG. 26.

The use of the ultraviolet-transmitting member to constitute the claw makes it possible to continuously irradiate the superhydrophilic film, which contains a photocatalyst, with an ultraviolet ray from the back of the coating liquid contacting surface of the claw, and thus to sustain an excited state of the photocatalyst and thereby reduce formation of a residue of liquid even in long-time continuous coating.

Examples of the ultraviolet-transmitting member include glass, acrylic resins and polyethylene films.

(Twelfth Embodiment)

Figure 27A:
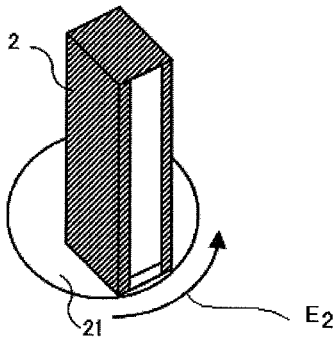
FIG. 27A is a perspective view of a structural example of a curtain coating apparatus of the present invention, showing an aspect in which a claw is in the shape of a disc and rotates.
Figure 27B:
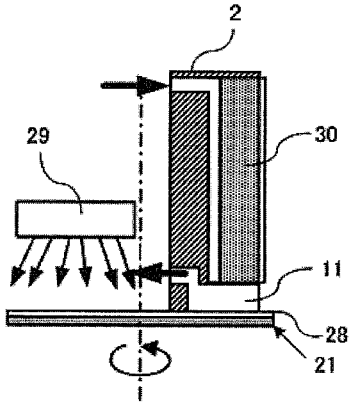
FIG. 27B is a cross-sectional view of the curtain coating apparatus shown in FIG. 27A.

A twelfth embodiment of the present invention is an embodiment in which the claw 21 placed at the bottom of the curtain edge guide 2 is in the shape of a disc and can rotate, the claw 21 has a photocatalyst-containing superhydrophilic film as its surface, and the light irradiation device 29 is provided, as shown in FIGS. 27(A) and 27(B).

By applying an ultraviolet ray to the photocatalyst-containing surface of the disc-shaped claw 21 other than the coating liquid contacting surface thereof while the claw 21 is being continuously rotated, it is possible to sustain an excited state of the photocatalyst-containing surface and thereby reduce formation of a residue of liquid even in long-time continuous coating.

The radius of the disc-shaped claw 21 is preferably in the range of 10 mm to 50 mm. If the radius is less than 10 mm, the curvature of a portion of the claw to support a curtain liquid film is great, causing the curtain liquid film to swing when applied, and thus the coating width becomes unstable. If the radius is greater than 50 mm, the apparatus cannot be made compact.

The rotational rate of the claw 21 as a circumferential speed is preferably greater than 0 m/sec and less than or equal to 0.05 m/sec. If the rotational rate as a circumferential speed is 0 m/sec, the coating liquid contacting surface of the claw cannot be sufficiently irradiated with the ultraviolet ray, thereby shortening the length of time for which continuous coating is possible. If the rotational rate as a circumferential speed is greater than 0.05 m/sec, the curtain liquid is film cannot be supported by an edge of the claw, and thus the curtain liquid film deviates inward.

(Thirteenth Embodiment)

Figure 28A:
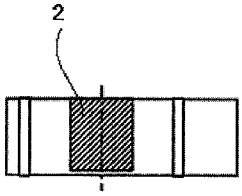
FIG. 28A is a schematic top view of a structural example of a curtain coating apparatus of the present invention, showing an aspect in which a claw moves back and forth.
Figure 28B:
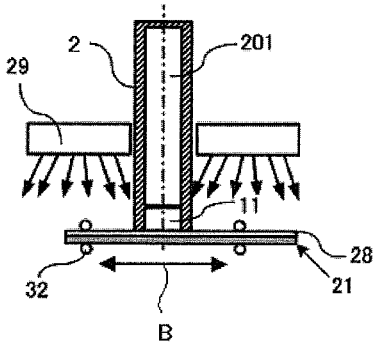
FIG. 28B is a cross-sectional front view of the curtain coating apparatus shown in FIG. 28A.

A thirteenth embodiment of the present invention is an embodiment in which the claw 21 placed at the bottom of the curtain edge guide 2 can move back and forth, the claw 21 has a photocatalyst-containing superhydrophilic film as its surface, and the light irradiation device 29 is provided, as shown in FIGS. 28A and 28B. Driving rubber rolls 32 are provided over and under the claw 21.

By applying an ultraviolet ray to the photocatalyst-containing surface of the claw 21 other than the coating liquid contacting surface thereof while the claw 21 is being continuously moved back and forth, it is possible to sustain an excited state of the photocatalyst-containing surface and thereby reduce formation of a residue of liquid even in long-time continuous coating.

The rate at which the claw 21 moves back and forth is preferably greater than 0 m/sec and less than or equal to 0.005 m/sec. If the rate is 0 m/sec, the coating liquid contacting surface of the claw cannot be sufficiently irradiated with the ultraviolet ray, thereby shortening the length of time for which continuous coating is possible. If the rate is greater than 0.005 m/sec, a curtain liquid film cannot be supported by an edge of the claw, and thus the curtain liquid film deviates inward.

(Fourteenth Embodiment)

Figure 29A:
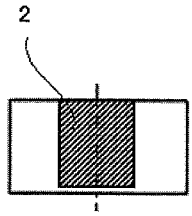
FIG. 29A is a schematic top view of a structural example of a curtain coating apparatus of the present invention, showing an aspect in which a claw is in the form of a belt and continuously moves.
Figure 29B:
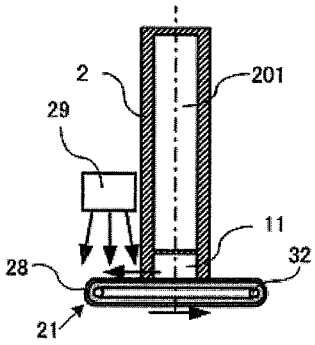
FIG. 29B is a cross-sectional front view of the curtain coating apparatus shown in FIG. 29A.

A fourteenth embodiment of the present invention is an embodiment in which the claw 21 placed at the bottom of a curtain edge guide 2 is in the form of a belt and can continuously move, the claw 21 has a photocatalyst-containing superhydrophilic film as its surface, and the light irradiation device 29 is provided, as shown in FIGS. 29A and 29B. Driving rubber rolls 32 are provided at both ends inside the belt-like claw 21.

By applying an ultraviolet ray to the photocatalyst-containing surface of the belt-like claw 21 other than the coating liquid contacting surface thereof while the claw 21 is being continuously moved, it is possible to sustain an excited state of the photocatalyst-containing surface and thereby reduce formation of a residue of liquid even in long-time continuous coating.

The rate at which the claw 21 moves is preferably greater than 0 m/sec and less than or equal to 0.005 m/sec. If the rate is 0 m/sec, the coating liquid contacting surface of the claw cannot be sufficiently irradiated with the ultraviolet ray, thereby shortening the length of time for which continuous coating is possible. If the rate is greater than 0.005 m/sec, a curtain liquid film cannot be supported by an edge of the claw, and thus the curtain liquid film deviates inward.

EXAMPLES

The following explains the present invention in further detail, referring to Examples and Comparative Examples. It should, however, be noted that the present invention is not confined to these Examples and Comparative Examples. The term "part(s)" used below means part(s) by mass.

Regarding these Examples, Examples 1, 2 and 19 pertain to the above-mentioned second embodiment of the present invention, Example 3 pertains to the above-mentioned third embodiment of the present invention, Example 4 pertains to the above-mentioned third embodiment of the present invention, Examples 5 to 12 pertain to the above-mentioned fourth embodiment of the present invention, Examples 13 and 14 pertain to the above-mentioned fifth embodiment of the present invention, Examples 15 to 17 pertain to the above-mentioned sixth embodiment of the present invention, Examples 18 and 20 to 26 pertain to the above-mentioned seventh embodiment of the present invention, Examples 27 to 33 pertain to the above-mentioned eighth embodiment of the present invention, Example 34 pertains to the above-mentioned ninth embodiment of the present invention, Examples 35 pertains to the above-mentioned tenth embodiment of the present invention, Examples 36 and 37 pertain to is the above-mentioned eleventh embodiment of the present invention, Examples 38 and 39 pertain to the above-mentioned twelfth embodiment of the present invention, Examples 40 and 41 pertain to the above-mentioned thirteenth embodiment of the present invention, and Examples 42 and 43 pertain to the above-mentioned fourteenth embodiment of the present invention.

Example 1

Figure 2:
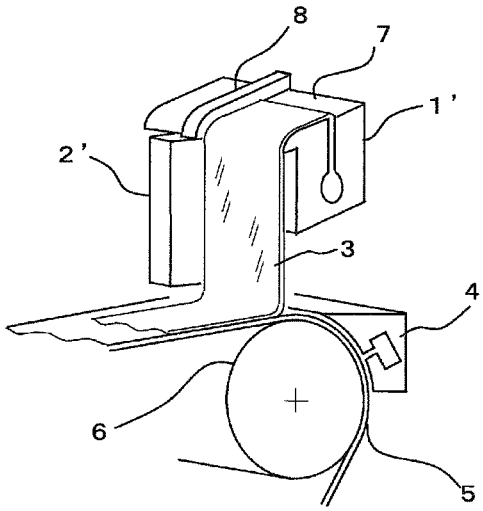
FIG. 2 (Prior Art)
FIG. 2 is a perspective view showing another structural example of a conventional curtain coating apparatus.
Figure 3:
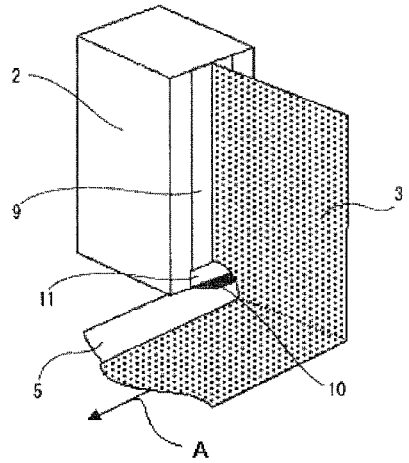
FIG. 3 (Prior Art)
FIG. 3 is a schematic drawing showing the structure of the vicinity of an edge of a curtain liquid film formed of a coating liquid, in a conventional curtain coating apparatus.
Figure 4:
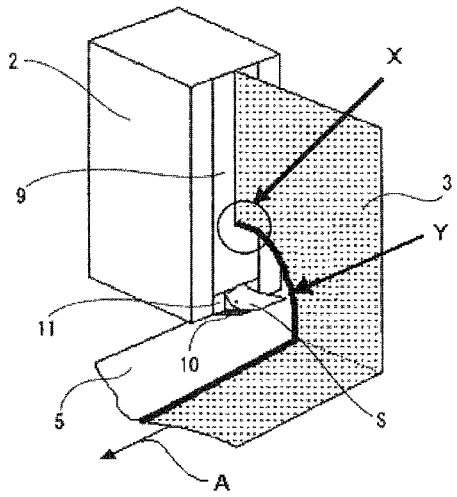
FIG. 4 (Prior Art)
FIG. 4 is a schematic drawing for explaining inward deviation of a curtain liquid film.

At a bottom of a curtain edge guide of the slide curtain coating apparatus shown in FIG. 2, the disc-shaped claw 102 shown in FIGS. 10A and 10B was installed in a rotatable manner, with a spindle fixed at the center of the claw. Then a thermosensitive recording layer coating liquid prepared according to the following formulation was applied onto a web (paper) at a coating speed of 400 m/min, with a coating width of 250 mm and at a flow rate of coating liquid (ejected from a nozzle slit) of 3,000 g/min. At that time, the disc-shaped claw was made of stainless steel and was 20 mm in radius and 0.18 mm in thickness, the volume of an auxiliary liquid (water) flowing along the curtain edge guide was 30 cc/min, and the suction pressure of a vacuum unit for recovering the auxiliary liquid was −8 kpa. Also, the claw 102 was made to protrude from a curtain liquid film contacting surface of a porous member 13 (which was made of ceramic and was 50 μm in average pore diameter and 52% in porosity) by 2 mm. The results are shown in Table 1-A.

(Thermosensitive recording layer coating liquid: 150 mPa·s in viscosity, 38 mN/m in static surface tension)

The static surface tension was measured using the Automatic Surface Tensiometer CBVP-A3 (manufactured by Kyowa Interface Science Co., Ltd.).

| | |
|---|---|
| 3-dibutylamino-6-methyl-7-anilinofluoran | 4 parts |
| 4-isopropoxy-4'-hydroxydiphenylsulfone | 12 parts |
| silica | 6 parts |
| 10% aqueous solution of polyvinyl alcohol | 16 parts |
| water | 41 parts |

Example 2

The thermosensitive recording layer coating liquid was applied onto a web in the same manner as in Example 1, except that the radius of the disc-shaped claw 102 was changed from 20 mm to 5 mm. The results are shown in Table 1-A.

Example 3

The thermosensitive recording layer coating liquid was applied onto a web in the same manner as in Example 1, except that the slide curtain coating apparatus shown in FIGS. 5A to 5C was used, in which a claw 101 (which was made of stainless steel and was 0.18 mm in thickness, 60 mm in length with respect to its moving direction and 30 mm in width) in the form of a flat plate was sandwiched between driving rubber rolls 14 and configured to move back and forth (at a rate of 0.005 m/sec). The results are shown in Table 1-A.

Example 4

Figure 15C:
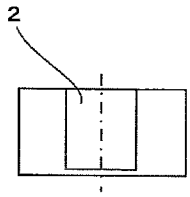
FIG. 15C is a schematic top view of the curtain coating apparatus shown in FIG. 15A.

The thermosensitive recording layer coating liquid was applied onto a web in the same manner as in Example 1, except that the slide curtain coating apparatus shown in FIGS. 15A to 15C was used, in which a belt-like claw 103 (which was made of stainless steel and was 0.01 mm in thickness, 80 mm in length with respect to its moving direction and 30 mm in width) was supported by driving rubber rolls 14 and was configured to move (at a rate of 0.005 m/sec). The results are shown in Table 1-A.

Example 5

The thermosensitive recording layer coating liquid was applied onto a web in the same manner as in Example 1, except that a peripheral portion of the disc-shaped claw 102 sloped at an angle of 30° as shown in FIG. 11. The results are shown in Table 1-A.

Example 6

The thermosensitive recording layer coating liquid was applied onto a web in the same manner as in Example 1, except that the peripheral portion of the disc-shaped claw 102 sloped at an angle of 45° as shown in FIG. 11. The results are shown in Table 1-A.

Example 7

The thermosensitive recording layer coating liquid was applied onto a web in the same manner as in Example 1, except that the peripheral portion of the disc-shaped claw 102 sloped at an angle of 50° as shown in FIG. 11. The results are shown in Table 1-A.

Example 8

The thermosensitive recording layer coating liquid was applied onto a web in the same manner as in Example 1, except that the peripheral portion of the disc-shaped claw 102 sloped at an angle of 5° as shown in FIG. 11. The results are shown in Table 1-A.

Example 9

The thermosensitive recording layer coating liquid was applied onto a web in the same manner as in Example 3, except that one edge of the claw 101 in the form of a flat plate sloped at an angle of 30° as shown in FIG. 6. The results are shown in Table 1-A.

Example 10

The thermosensitive recording layer coating liquid was applied onto a web in the same manner as in Example 3, except that the one edge of the claw 101 in the form of a flat plate sloped at an angle of 45° as shown in FIG. 6. The results are shown in Table 1-A.

Example 11

The thermosensitive recording layer coating liquid was applied onto a web in the same manner as in Example 3, except that the one edge of the claw 101 in the form of a flat plate sloped at an angle of 50° as shown in FIG. 6. The results are shown in Table 1-A.

Example 12

The thermosensitive recording layer coating liquid was applied onto a web in the same manner as in Example 3, except that the one edge of the claw 101 in the form of a flat plate sloped at an angle of 5° as shown in FIG. 6. The results are shown in Table 1-A.

Example 13

Figure 12A:
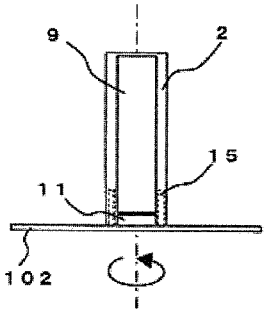
FIG. 12A is a schematic front view showing a structural example of a curtain coating apparatus in which attachment of the claw 102 to the curtain edge guide 2 is facilitated.
Figure 12B:
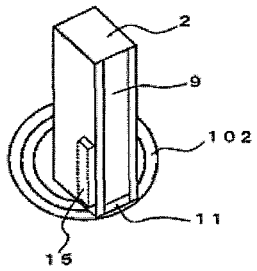
FIG. 12B is a perspective view of the curtain coating apparatus shown in FIG. 12A.

The thermosensitive recording layer coating liquid was applied onto a web in the same manner as in Example 1, except that the slide curtain coating apparatus shown in FIGS. 12A and 12B was used, in which a magnetic member (magnet) 15 was attached to a curtain edge guide 2, the disc-shaped claw 102 (which was 20 mm in radius and 0.18 mm in thickness) was made of stainless steel (SUS 420) attracted to the magnetic member (magnet) 15, and the rotational rate of the claw as a circumferential speed was 0.01 m/sec. The results are shown in Table 1-A.

Example 14

The thermosensitive recording layer coating liquid was applied onto a web in the same manner as in Example 1, except that the slide curtain coating apparatus shown in FIGS. 7A and 7B was used, in which a magnetic member (magnet) 15 was attached to a curtain edge guide 2, the claw 101 (which was 0.18 mm in thickness, 60 mm in length with respect to its moving direction and 30 mm in width) in the form of a flat plate was made of stainless steel (SUS 420) attracted to the magnetic member (magnet) 15, and the rate at which the claw moved back and forth was 0.005 m/sec. The results are shown in Table 1-A.

Example 15

The thermosensitive recording layer coating liquid was applied onto a web in the same manner as in Example 1, except that a sheet of Teflon (registered trademark) having a thickness of 100 μm was affixed onto the coating liquid (curtain liquid film) contacting surface of the disc-shaped claw 102. The results are shown in Table 1-A.

Example 16

The thermosensitive recording layer coating liquid was applied onto a web in the same manner as in Example 3, except that a sheet of Teflon (registered trademark) having a thickness of 100 μm was affixed onto the coating liquid (curtain liquid film) contacting surface of the claw 101 which was in the form of a flat plate. The results are shown in Table 1-B.

Example 17

The thermosensitive recording layer coating liquid was applied onto a web in the same manner as in Example 4, except that a sheet of Teflon (registered trademark) having a thickness of 100 μm was affixed onto the coating liquid (curtain liquid film) contacting surface of the belt-like claw 103. The results are shown in Table 1-B.

Example 18

The thermosensitive recording layer coating liquid was applied onto a web in the same manner as in Example 1, except that the slide curtain coating apparatus shown in FIGS. 13A and 13B was used, in which the disc-shaped claw 102 was configured to rotate at a circumferential speed of 0.0001 m/sec by a drive motor, a circular brush 16 was installed on the opposite side to a curtain edge guide 2 and continuously rotated (at a circumferential speed of 0.05 m/sec) so as to oppose the rotational direction of the disc-shaped claw 102, and a residue of the liquid remaining on the disc-shaped claw was sucked (under a suction pressure of −0.01 MPa) by a residue-sucking vacuum unit 17. The results are shown in Table 1-B.

Example 19

The thermosensitive recording layer coating liquid was applied onto a web in the same manner as in Example 18, except that the circumferential speed of the disc-shaped claw 102 was changed to 0.1 m/sec. The results are shown in Table 1-B.

Example 20

Figure 14C:
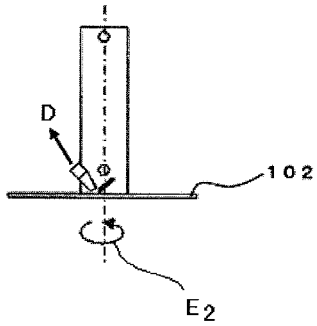
FIG. 14C is a schematic side view of the curtain coating apparatus shown in FIG. 14A.

The slide curtain coating apparatus shown in FIGS. 14A to 14C was used, in which the disc-shaped claw 102, the same one as in Example 1, was configured to rotate at a circumferential speed of 0.0001 m/sec by a drive motor, a scraper blade 18 (which was made of polyethylene and was 0.4 mm in thickness) was installed in a slanting manner on the opposite side to a curtain edge guide 2 so as to oppose the rotational direction of the disc-shaped claw 102, and a residue of liquid remaining on the disc-shaped claw was sucked (under a suction pressure of −0.01 MPa) by a residue-sucking vacuum unit 17. The results are shown in Table 1-B.

Example 21

The slide curtain coating apparatus shown in FIGS. 8A and 8B was used, in which the length (with respect to its moving direction) of the claw 101 in the form of a flat plate, the same one as in Example 3, was increased to 100 mm, the claw 101 was sandwiched between driving rubber rolls 14, the driving rubber rolls 14 were rotated by a drive motor so as to move the claw 101 back and forth in a controlled manner at a rate of 0.0005 m/sec, circular brushes 16 were continuously rotated (at a circumferential speed of 0.05 m/sec) between a curtain edge guide 2 and the driving rubber rolls 14 so as to oppose the moving direction of the claw, and a residue of liquid remaining on the claw was sucked (under a suction pressure of −0.01 MPa) by residue-sucking vacuum units 17. The results are shown in Table 1-B.

Example 22

The thermosensitive recording layer coating liquid was applied onto a web in the same manner as in Example 21, except that the claw 101 was configured to move back and forth in a controlled manner at a rate of 0.01 m/sec. The results are shown in Table 1-B.

Example 23

The slide curtain coating apparatus shown in FIGS. 9A and 9B was used, in which the length (with respect to its moving direction) of the claw 101 in the form of a flat plate, the same one as in Example 3, was increased to 100 mm, the claw 101 was sandwiched between driving rubber rolls 14, the driving rubber rolls 14 were rotated by a drive motor so as to move the claw 101 back and forth in a controlled manner at a rate of 0.00005 m/sec, scraper blades 18 (which were made of polyethylene and were 0.4 mm in thickness each) were installed in a slanting manner between a curtain edge guide and the driving rubber rolls so as to oppose the moving direction of the claw, and a residue of liquid remaining on the claw was sucked (under a suction pressure of −0.01 MPa) by residue-sucking vacuum units 17. The results are shown in Table 1-B.

Example 24

The slide curtain coating apparatus shown in FIGS. 16A and 16B was used, in which the belt-like claw 103, the same one as in Example 4, was supported by driving rubber rolls 14, the driving rubber rolls 14 were rotated by a drive motor so as to move the claw 103 in one direction at a rate of 0.00005 m/sec, a circular brush 16 was continuously rotated (at a circumferential speed of 0.05 m/sec) so as to oppose the moving direction of the claw 103, and a residue of liquid remaining on the claw was sucked (under a suction pressure of −0.01 MPa) by a residue-sucking vacuum unit 17. The results are shown in Table 1-B.

Example 25

The thermosensitive recording layer coating liquid was applied onto a web in the same manner as in Example 24, except that the rate at which the claw 103 moved was changed to 0.01 m/sec. The results are shown in Table 1-B.

Example 26

The slide curtain coating apparatus shown in FIGS. 17A and 17B was used, in which the belt-like claw 103, the same one as in Example 4, was supported by driving rubber rolls 14, the driving rubber rolls 14 were rotated by a drive motor so as to move the claw 103 in one direction at a rate of 0.00005 m/sec, a scraper blade 18 (which was made of polyethylene and was 0.4 mm in thickness) was installed in a slanting manner so as to oppose the moving direction of a residue of liquid on the claw, and the residue was sucked (under a suction pressure of −0.01 MPa) by a vacuum unit 17. The results are shown in Table 1-B.

Comparative Example 1

As shown in FIG. 2, a bottom of a curtain edge guide of a slide curtain coating apparatus was fixed, and coating was carried out as in Example 1. The results are shown in Table 1-B.

Comparative Example 2

Coating was carried out in the same manner as in Example 1, except that the claw was not configured to rotate. The results are shown in Table 1-B.

Comparative Example 3

Coating was carried out in the same manner as in Example 3, except that the claw was not configured to move back and forth. The results are shown in Table 1-B.

Comparative Example 4

Coating was carried out in the same manner as in Example 4, except that the claw was not configured to move. The results are shown in Table 1-B.

TABLE 1-A

| Sample | Results |
|---|---|
| Ex. 1 | Although a residue was attached to the claw, the residue could be removed from the claw by rotating the claw once every 1.5 hr, and thus the curtain liquid film did not deviate inward. The presence of a residue on the liquid contacting surface of the claw could be constantly prevented by cleaning it off. |
| Ex. 2 | The curvature of the arc of the claw was so great that the curtain liquid film could not be stably supported, and thus the curtain liquid film deviated inward. |
| Ex. 3 | Although a residue was attached to the claw, the residue could be removed from the claw by moving the claw once every 1.5 hr, and thus the curtain liquid film did not deviate inward. The presence of a residue on the liquid contacting surface of the claw could be constantly prevented by cleaning it off. |
| Ex. 4 | Although a residue was attached to the claw, the residue could be removed from the claw by moving the claw once every 1.5 hr, and thus the curtain liquid film did not deviate inward. The presence of a residue on the liquid contacting surface of the claw could be constantly prevented by cleaning it off. |
| Ex. 5 | Although a residue was attached to the claw, the residue could be removed from the claw by rotating the claw once every 1.5 hr, and thus the curtain liquid film did not deviate inward. The presence of a residue on the liquid contacting surface of the claw could be constantly prevented by cleaning it off. |
| Ex. 6 | Although a residue was attached to the claw, the residue could be removed from the claw by rotating the claw once every 1.5 hr, and thus the curtain liquid film did not deviate inward. The presence of a residue on the liquid contacting surface of the claw could be constantly prevented by cleaning it off. |
| Ex. 7 | A residue was attached to the back of the claw as well, and the curtain liquid film swung in the width direction, so that the curtain liquid film could not be stably supported, and thus the curtain liquid film deviated inward. |
| Ex. 8 | The curtain liquid film was difficult to support and deviated inward immediately after the start. |
| Ex. 9 | Although a residue was attached to the claw, the residue could be removed from the claw by moving the claw once every 1.5 hr, and thus the curtain liquid film did not deviate inward. The presence of a residue on the liquid contacting surface of the claw could be constantly prevented by cleaning it off. |
| Ex. 10 | Although a residue was attached to the claw, the residue could be removed from the claw by moving the claw once every 1.5 hr, and thus the curtain liquid film did not deviate inward. The presence of a residue on the liquid contacting surface of the claw could be constantly prevented by cleaning it off. |
| Ex. 11 | A residue was attached to the back of the claw as well, and the curtain liquid film swung in the width direction, so that the curtain liquid film could not be stably supported, and thus the curtain liquid film deviated inward. |
| Ex. 12 | The curtain liquid film was difficult to support and deviated inward immediately after the start. |
| Ex. 13 | Although a residue was attached to the claw, the residue could be removed from the claw by rotating the claw once every 1.5 hr, and thus the curtain liquid film did not deviate inward. The presence of a residue on the liquid contacting surface of the claw could he constantly prevented by cleaning it off. Also, the disc-shaped claw was easy to fix, and the curtain liquid film was stable. |
| Ex. 14 | Although a residue was attached to the claw, the residue could be removed from the claw by moving the claw once every 1.5 hr, and thus the curtain liquid film did not deviate inward. The presence of a residue on the liquid contacting surface of the claw could be constantly prevented by cleaning it off. Also, the claw was easy to fix, and the curtain liquid film was stable. |
| Ex. 15 | Although a residue was attached to the claw, the residue could be removed from the claw by rotating the claw once every 24 hr, and thus the curtain liquid film did not deviate inward. The presence of a residue on the liquid contacting surface of the claw could be constantly prevented by cleaning it off. |

TABLE 1-B

| Sample | Results |
|---|---|
| Ex. 16 | Although a residue was attached to the claw, the residue could be removed from the claw by moving the claw once every 24 hr, and thus the curtain liquid film did not deviate inward. The presence of a residue on the liquid contacting surface of the claw could be constantly prevented by cleaning it off. |
| Ex. 17 | Although a residue was attached to the claw, the residue could be removed from the claw by moving the claw once every 24 hr, and thus the curtain liquid film did not deviate inward. The presence of a residue on the liquid contacting surface of the claw could be constantly prevented by cleaning it off. |
| Ex. 18 | Although a residue was attached to the claw, the residue could be constantly removed from the claw by continuously rotating the claw, and thus the curtain liquid film did not deviate inward. |
| Ex. 19 | The circumferential speed of the disc-shaped claw was so high that the curtain liquid film could not be supported and thus deviated inward. |
| Ex. 20 | Although a residue was attached to the claw, the residue could be constantly removed from the claw by continuously rotating the claw, and thus the curtain liquid film did not deviate inward. |

TABLE 1-B-continued

| Sample | Results |
|---|---|
| Ex. 21 | Although a residue was attached to the claw, the residue could be constantly removed from the claw by continuously moving the claw back and forth, and thus the curtain liquid film did not deviate inward. |
| Ex. 22 | The rate (speed) at which the claw moved was so high that the curtain liquid film could not be supported and thus deviated inward. |
| Ex. 23 | Although a residue was attached to the claw, the residue could be constantly removed from the claw by continuously moving the claw back and forth, and thus the curtain liquid film did not deviate inward. |
| Ex. 24 | Although a residue was attached to the claw, the residue could be constantly removed from the claw by continuously moving the claw, and thus the curtain liquid film did not deviate inward. |
| Ex. 25 | The rate (speed) at which the claw moved was so high that the curtain liquid film could not be supported and thus deviated inward. |
| Ex. 26 | Although a residue was attached to the claw, the residue could be constantly removed from the claw by continuously moving the claw, and thus the curtain liquid film did not deviate inward. |
| Comp. Ex. 1 | A residue was attached to the claw, and the curtain liquid film deviated inward 1.5 hr after the start. |
| Comp. Ex. 2 | A residue was attached to the claw, and the curtain liquid film deviated inward 1.5 hr after the start. |
| Comp. Ex. 3 | A residue was attached to the claw, and the curtain liquid film deviated inward 1.5 hr after the start. |
| Comp. Ex. 4 | A residue was attached to the claw, and the curtain liquid film deviated inward 1.5 hr after the start. |

Example 27

Figure 19A:
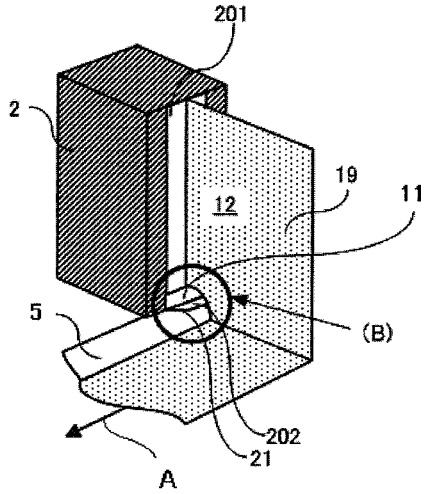
FIG. 19A is a perspective view schematically showing a structural example of a curtain coating apparatus of the present invention.
Figure 19B:
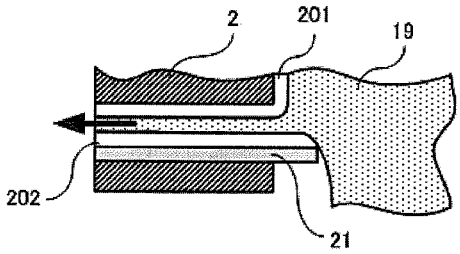
FIG. 19B is a cross-sectional view of the vicinity of a claw of the curtain coating apparatus shown in FIG. 19A.

An apparatus was used that included the slide curtain coating apparatus shown in FIG. 2, the claw 21 shown in FIGS. 19A and 19B provided at a bottom of the curtain edge guide of the slide curtain coating apparatus, and the two pouring pipes 27 shown in FIG. 21, in which it was possible to make an auxiliary liquid flow as far as an edge of the claw. Water was used as the auxiliary liquid.

A thermosensitive recording layer coating liquid prepared according to the following formulation was applied onto a web (paper) at a coating speed of 400 m/min, with a coating width of 250 mm and at a flow rate of coating liquid (ejected from a nozzle slit) of 3,000 g/min.

At that time, the volume of the auxiliary liquid (water) on the liquid contacting surface of the claw (the volume of the claw liquid-contacting surface auxiliary liquid 202) was 120 cc/min (60 cc/min each), the volume of an auxiliary liquid (water) flowing along the curtain edge guide (the volume of a curtain edge guide auxiliary liquid 201) was 30 cc/min, and the suction pressure of a vacuum unit for recovering the auxiliary liquid was −20 kpa. Also, the claw was made to protrude from a curtain liquid film contacting surface of a porous member by 2 mm. Further, the thickness of the edge of the claw, denoted by the numeral 26 in FIG. 20, was 0.1 mm, and the angle θ at which the edge of the claw sloped, denoted by the numeral 25 in FIG. 20, was 30°. The results are shown in Table 2.

(Thermosensitive recording layer coating liquid: 150 mPa·s in viscosity, 38 mN/m in static surface tension)

The static surface tension was measured using the Automatic Surface Tensiometer CBVP-A3 (manufactured by Kyowa Interface Science Co., Ltd.).

| | |
|---|---|
| 3-dibutylamino-6-methyl-7-anilinofluoran | 4 parts |
| 4-isopropoxy-4'-hydroxydiphenylsulfone | 12 parts |
| silica | 6 parts |
| 10% aqueous solution of polyvinyl alcohol | 16 parts |
| water | 41 parts |

Example 28

The thermosensitive recording layer coating liquid was applied onto a web in the same manner as in Example 27, except that the angle at which the edge of the claw 21 sloped was changed to 0°. The results are shown in Table 2.

Example 29

The thermosensitive recording layer coating liquid was applied onto a web in the same manner as in Example 27, except that the angle at which the edge of the claw 21 sloped was changed to 45°. The results are shown in Table 2.

Reference Example 1

The thermosensitive recording layer coating liquid was applied onto a web in the same manner as in Example 27, except that the angle at which the edge of the claw 21 sloped was changed to 50°. The results are shown in Table 2.

Reference Example 2

The thermosensitive recording layer coating liquid was applied onto a web in the same manner as in Example 27, except that the angle at which the edge of the claw 21 sloped was changed to −5°. The results are shown in Table 2.

Example 30

The thermosensitive recording layer coating liquid was applied onto a web in the same manner as in Example 27, except that the thickness of the edge of the claw 21 was changed to 0.4 mm. The results are shown in Table 2.

Reference Example 3

The thermosensitive recording layer coating liquid was applied onto a web in the same manner as in Example 27, except that the thickness of the edge of the claw 21 was changed to 0.5 mm. The results are shown in Table 2.

Example 31

The thermosensitive recording layer coating liquid was applied onto a web in the same manner as in Example 27, except that the auxiliary liquid (water) was poured such that the volume of the auxiliary liquid (water) on the liquid contacting surface of the claw 21 (the volume of the claw liquid-contacting surface auxiliary liquid 202) was 100 cc/min, as shown in FIG. 22. The results are shown in Table 2.

Example 32

The thermosensitive recording layer coating liquid was applied onto a web in the same manner as in Example 27, except that a claw surface 24 was formed of stainless steel mesh, and the auxiliary liquid (water) was poured such that the volume of the auxiliary liquid (water) streaming onto the liquid contacting surface of the claw 21 (the volume of the claw liquid-contacting surface auxiliary liquid 202) was 100 cc/min, as shown in FIG. 23. The results are shown in Table 2.

Example 33

The thermosensitive recording layer coating liquid was applied onto a web in the same manner as in Example 27, except that the claw surface 24 was formed of a porous member, and the auxiliary liquid (water) was poured such that the volume of the auxiliary liquid (water) streaming onto the liquid contacting surface of the claw 21 (the volume of the claw liquid-contacting surface auxiliary liquid 202) was 100 cc/min, as shown in FIG. 23. The results are shown in Table 2.

Example 34

The thermosensitive recording layer coating liquid was applied onto a web in the same manner as in Example 27, except that a photocatalyst sheet (HYDROTECTFILM, produced by TOTO LTD.) was affixed as a superhydrophilic film 28 to the surface (coating liquid contacting surface) of the claw 21, as shown in FIG. 24. The results are shown in Table 2.

Example 35

The thermosensitive recording layer coating liquid was applied onto a web in the same manner as in Example 34, except that the surface (coating liquid contacting surface) of the claw 21 was irradiated with an ultraviolet ray using a black light as a light irradiation device 29, as shown in FIG. 25. The results are shown in Table 2.

Example 36

The thermosensitive recording layer coating liquid was applied onto a web in the same manner as in Example 27, except that the claw 21, formed by affixing a photocatalyst sheet (HYDROTECTFILM, produced by TOTO LTD.) as a superhydrophilic film 28 to a surface of a PET film (0.2 mm in thickness) as an ultraviolet-transmitting member 31, was irradiated with an ultraviolet ray from the surface opposite to the coating liquid contacting surface, using an ultraviolet lamp (TBB-30, manufactured by HYBEC CORPORARION) having a tube diameter of 3 mm and a length of 30 mm and serving as a light irradiation device 29, as shown in FIG. 26. The results are shown in Table 2.

Example 37

The thermosensitive recording layer coating liquid was applied onto a web in the same manner as in Example 36, except that the claw was not irradiated with an ultraviolet ray. The results are shown in Table 2.

Example 38

The thermosensitive recording layer coating liquid was applied onto a web in the same manner as in Example 27, except that the claw 21 was a disc-shaped claw (which was made of stainless steel and was 20 mm in radius and 0.18 mm in thickness), a photocatalyst sheet (HYDROTECTFILM, produced by TOTO LTD.) was affixed as a superhydrophilic film 28 to the coating liquid contacting surface of the claw 21, the claw 21 was rotated at a circumferential speed of 0.0001 m/sec by a drive motor, and the surface of the claw 21 was irradiated with an ultraviolet ray using a black light as a light irradiation device 29, as shown in FIGS. 27A and 27B. The results are shown in Table 2.

Example 39

The thermosensitive recording layer coating liquid was applied onto a web in the same manner as in Example 38, except that the disc-shaped claw 21 was not rotated. The results are shown in Table 2.

Reference Example 4

The thermosensitive recording layer coating liquid was applied onto a web in the same manner as in Example 38, except that the circumferential speed of the claw 21 was changed to 0.1 m/sec. The results are shown in Table 2.

Example 40

The thermosensitive recording layer coating liquid was applied onto a web in the same manner as in Example 27, except that the length of the claw 21 with respect to its moving direction was changed to 1,000 mm, the width of the claw 21 was changed to 30 mm, a photocatalyst sheet (HYDROTECTFILM, produced by TOTO LTD.) was affixed as a superhydrophilic film 28 to the coating liquid contacting surface of the claw, the claw with the superhydrophilic film was sandwiched between driving rubber rolls 32 and configured to move back and forth in a controlled manner at a rate of 0.00005 m/sec by a motor, and the superhydrophilic film 28 was irradiated with an ultraviolet ray using a black light as a light irradiation device 29, as shown in FIGS. 28A and 28B. The results are shown in Table 2.

Example 41

The thermosensitive recording layer coating liquid was applied onto a web in the same manner as in Example 40, except that the claw 21 was not configured to move back and forth. The results are shown in Table 2.

Reference Example 5

The thermosensitive recording layer coating liquid was applied onto a web in the same manner as in Example 40, except that the rate at which the claw 21 moved back and forth was changed to 0.01 m/sec. The results are shown in Table 2.

Example 42

The thermosensitive recording layer coating liquid was applied onto a web in the same manner as in Example 27, except that the claw 21 was made of stainless steel and was in the form of a belt (which was 800 mm in length with respect to its moving direction, 30 mm in width and 0.01 mm in thickness), a photocatalyst sheet (HYDROTECTFILM, produced by TOTO LTD.) was affixed as a superhydrophilic film 28 to the coating liquid contacting surface of the claw, the claw with the superhydrophilic film was supported by driving rubber rolls 32 and configured to move at a rate of 0.00005 m/sec by the use of a drive motor, and the superhydrophilic film 28 was irradiated with an ultraviolet ray using a black light as a light irradiation device 29, as shown in FIGS. 29A and 29B. The results are shown in Table 2.

Example 43

The thermosensitive recording layer coating liquid was applied onto a web in the same manner as in Example 42, except that the claw 21 was not moved. The results are shown in Table 2.

Reference Example 6

The thermosensitive recording layer coating liquid was applied onto a web in the same manner as in Example 42, except that the rate at which the claw 21 moved was changed to 0.01 m/sec. The results are shown in Table 2.

Comparative Example 1

The thermosensitive recording layer coating liquid was applied onto a web in the same manner as in Example 27, except that an auxiliary liquid was not poured onto the coating liquid contacting is surface of the claw 21. The results are shown in Table 2.

TABLE 2

| | Results | |
|---|---|---|
| | Residue on coating liquid contacting surface of claw | Inward deviation of curtain liquid film |
| Ex. 28 | The presence of a residue could be constantly prevented. | The curtain liquid film did not deviate inward. |
| Ex. 29 | The presence of a residue could be constantly prevented. | The curtain liquid film did not deviate inward. |
| Ex. 30 | The presence of a residue could be constantly prevented. | The curtain liquid film did not deviate inward. |
| Ref. Ex. 1 | A residue was attached to the back of the claw | The curtain liquid film deviated inward 1 hr after the start. |
| Ref. Ex. 2 | A residue was attached. | The curtain liquid film deviated inward 1.5 hr after the start. |
| Ex. 4 | The presence of a residue could be constantly prevented. | The curtain liquid film did not deviate inward. |
| Ref. Ex. 3 | A residue was attached to the edge of the claw. | The curtain liquid film deviated inward 1.5 hr after the start. |
| Ex. 31 | The presence of a residue could be constantly prevented. | The curtain liquid film did not deviate inward. |
| Ex. 32 | The presence of a residue could be constantly prevented. | The curtain liquid film did not deviate inward. |
| Ex. 33 | The presence of a residue could be constantly prevented. | The curtain liquid film did not deviate inward. |
| Ex. 34 | No residue was present until 16 hr after the start, then a residue started to exist. | The curtain liquid film deviated inward 18 hr after the start. |
| Ex. 35 | The presence of a residue could be constantly prevented. | The curtain liquid film did not deviate inward. |
| Ex. 36 | The presence of a residue could be constantly prevented. | The curtain liquid film did not deviate inward. |
| Ex. 37 | No residue was present until 16 hr after the start, then a residue started to exist. | The curtain liquid film deviated inward 18 hr after the start. |
| Ex. 38 | The presence of a residue could be constantly prevented. | The curtain liquid film did not deaviate inward. |
| Ex. 39 | No residue was present until 16 hr after the start, then a residue started to exist. | The curtain liquid film deviated inward 18 hr after the start. |
| Ref. Ex. 4 | The curtain liquid film was difficult to support. | The curtain liquid film deviated inward immediately after the start. |
| Ex. 40 | The presence of a residue could be constantly prevented. | The curtain liquid film did not deviate inward. |
| Ex. 41 | No residue was present until 16 hr after the start, then a residue started to exist. | The curtain liquid film deviated inward 18 hr after the start. |
| Ref. Ex. 5 | The curtain liquid film was difficult to support. | The curtain liquid film deviated inward immediately after the start. |
| Ex. 42 | The presence of a residue could be constantly prevented. | The curtain liquid film did not deviate inward. |
| Ex. 43 | No residue was present until 16 hr after the start, then a residue started to exist. | The curtain liquid film deviated inward 18 hr after the start. |

TABLE 2-continued

| | Results | |
|---|---|---|
| | Residue on coating liquid contacting surface of claw | Inward deviation of curtain liquid film |
| Ref. Ex. 6 | The curtain liquid film was difficult to support. | The curtain liquid film deviated inward immediately after the start. |
| Comp. Ex. 1 | A residue was attached. | The curtain liquid film deviated inward 1.5 hr after the start. |

What is claimed is:

1. A curtain coating apparatus comprising:

a slit from which at least one layer of a coating liquid is ejected, a curtain edge guide configured to guide the ejected coating liquid in the form of a curtain liquid film and make the coating liquid fall freely, while providing an auxiliary liquid along a curtain edge guide surface provided in contact with the coating liquid, so as to apply the coating liquid onto a continuously running web, and a ledge which supports the curtain liquid film at a bottom of the curtain edge guide, wherein the ledge is configured to move to remove a residue of the coating liquid from the ledge, wherein the ledge is disc-shaped and is configured to rotate, and wherein a radius of the ledge is in a range of 10 mm to 50 mm.

2. The curtain coating apparatus according to claim 1, wherein a peripheral portion of the ledge slopes at an angle relative to a remainder of the ledge.

3. The curtain coating apparatus according to claim 2, wherein the angle is in the range of 0° to 45°.

4. The curtain coating apparatus according to claim 1, wherein the curtain edge guide is provided with a magnetic material, and part or all of the ledge is made of a magnetic material or a material attracted to the magnetic material of the curtain edge guide.

5. The curtain coating apparatus according to claim 1, wherein the ledge has a coating liquid contacting surface formed of a hydrophobic member.

6. The curtain coating apparatus according to claim 1, further comprising a residue cleaning unit configured to clean off a residue of the coating liquid from the ledge as the ledge moves.

7. The curtain coating apparatus according to claim 1, further comprising a pouring pipe for supplying the additional auxiliary liquid to the curtain liquid film contacting surface of the ledge, wherein the unit is configured to bring the additional auxiliary liquid into contact with the curtain liquid film contacting surface such that the additional auxiliary liquid flows on the curtain liquid film contacting surface.

8. The curtain coating apparatus according to claim 1, wherein the curtain liquid film contacting surface of the ledge is formed of a superhydrophilic film which contains a superhydrophilic material.

9. The curtain coating apparatus according to claim 1, further comprising a ledge moving member configured to move the ledge while the coating liquid is applied onto the continuously running web to remove a residue of the coating liquid from the ledge.

* * * * *